US012618178B2

(12) United States Patent
T'Sas

(10) Patent No.: US 12,618,178 B2
(45) Date of Patent: May 5, 2026

(54) WEAVING MACHINE AND METHOD FOR MANUFACTURING PILE FABRICS WITH KNOTTED PILE YARNS

(71) Applicant: MOVINT, Roeselare (BE)

(72) Inventor: Francois T'Sas, Kaliningrad (RU)

(73) Assignee: MOVINT, Roeselare (BE)

( * ) Notice: Subject to any disclaimer, the term of this patent is extended or adjusted under 35 U.S.C. 154(b) by 0 days.

(21) Appl. No.: 18/997,787

(22) PCT Filed: Jul. 20, 2023

(86) PCT No.: PCT/IB2023/057397
§ 371 (c)(1),
(2) Date: Jan. 22, 2025

(87) PCT Pub. No.: WO2024/018411
PCT Pub. Date: Jan. 25, 2024

(65) Prior Publication Data

US 2026/0022502 A1 Jan. 22, 2026

(30) Foreign Application Priority Data

Jul. 22, 2022 (BE) ..... 2022/5588

(51) Int. Cl.
*D03D 27/12* (2006.01)
*D03D 27/04* (2006.01)
(Continued)

(52) U.S. Cl.
CPC ..... *D03D 27/04* (2013.01); *D03D 27/12* (2013.01); *D03D 39/00* (2013.01)

(58) Field of Classification Search
CPC ..... D03D 27/04; D03D 27/12; D03D 39/00
See application file for complete search history.

(56) References Cited

U.S. PATENT DOCUMENTS 717,017 A * 12/1902 Panitschek et al. ... D03D 27/12 139/400
1,440,779 A * 1/1923 Frenzel ..... D03D 39/02 139/5

(Continued)

FOREIGN PATENT DOCUMENTS

DE 63864 C 8/1892
GB 493807 A 10/1938

OTHER PUBLICATIONS

International Search Report and Written Opinion for International Application No. PCT/IB2023/057397, mailing date of Oct. 20, 2023.

*Primary Examiner* — Robert H Muromoto, Jr.
(74) *Attorney, Agent, or Firm* — FRESH IP PLC; Clifford D. Hyra; Aubrey Y. Chen

(57) ABSTRACT

A method and a weaving machine for weaving pile fabrics with knotted pile yarns, configured so that, for sequences (I), (II), (III) of two warp yarn systems, the order of the warp yarn systems in the weft insertion mechanism (X) is changed and a pile yarn (P1)-(P4) is brought between the warp yarn systems, at least one warp yarn (1) of the first warp yarn system and at least one warp yarn (2) of the second warp yarn system are brought back into the original order on either side of a gap (T3), and finally an end part (L1*a*)-(L4*a*) of the pile yarn (P1)-(P4) is brought through this gap (T3) from the one edge (20) to the other edge (30) of the warp yarns (1), (2), so that a knot ($PK_1$), ($PK_2$), ($PK_3$), ($JK_1$), ($JK_2$) is formed.

26 Claims, 27 Drawing Sheets

(51) Int. Cl.
*D03D 39/00* (2006.01)
*D03D 27/00* (2006.01)

(56) References Cited

U.S. PATENT DOCUMENTS

| | | | | | |
|---|---|---|---|---|---|
| 1,651,812 | A * | 12/1927 | Reich | D03D 39/02 | 139/4 |
| 1,987,973 | A * | 1/1935 | Rice | D03D 39/02 | 139/5 |
| 2,709,458 | A * | 5/1955 | Hoeselbarth | D03D 27/06 | 139/39 |
| 2,836,201 | A * | 5/1958 | Hoeselbarth | D03D 39/00 | 139/39 |
| 3,055,401 | A * | 9/1962 | Park | D03D 27/06 | 139/402 |
| 6,945,280 | B2 * | 9/2005 | Debaes | D03D 27/10 | 139/116.5 |
| 7,861,747 | B2 * | 1/2011 | Quigley | D21F 1/0045 | 139/383 R |
| 8,589,630 | B2 | 11/2013 | Irish et al. | | |
| 2007/0006932 | A1 * | 1/2007 | Mertens | D03D 39/16 | 139/37 |
| 2007/0175534 | A1 * | 8/2007 | Barrett | D21F 1/0027 | 139/383 A |
| 2009/0205740 | A1 * | 8/2009 | Quigley | D21F 1/0045 | 139/408 |

* cited by examiner

WEAVING MACHINE AND METHOD FOR MANUFACTURING PILE FABRICS WITH KNOTTED PILE YARNS

This application is a National Phase entry of International Application No. PCT/IB2023/057397 under § 371 and claims the benefit of Belgian Patent Application No. BE2022/5588, filed Jul. 22, 2022, which is hereby incorporated by reference in its entirety.

FIELD OF THE DISCLOSURE

The present disclosure relates on the one hand to a weaving machine for weaving pile fabrics, comprising yarn providers for providing a number of warp yarns running next to each other, a shedding device for forming a shed between the warp yarns in each case in several weft insertion cycles, a weft insertion mechanism for inserting, in the weft insertion cycles, in each case at least one weft yarn in a weft direction in the shed in order to weave a ground fabric, and yarn binders for binding pile yarns to the ground fabric to form pile on the ground fabric.

The present disclosure also relates to a weaving machine with the features indicated in the preceding paragraph, which is ready for weaving a pile fabric and which thus comprises a number of warp yarns running next to each other.

The present disclosure also relates on the other hand to a method for manufacturing pile fabrics, wherein a number of warp yarns running next to each other are provided, and wherein in several weft insertion cycles in each case a shed is formed between the warp yarns, and at least one weft yarn is inserted in a weft direction into the shed so that a ground fabric is woven, and pile yarns are bound to the ground fabric to form pile on the ground fabric.

The present disclosure relates in particular to a method of this kind and a weaving machine of this kind for manufacturing pile fabrics with pile-forming pile yarns which respectively form a closed loop round at least one warp yarn of the ground fabric, and are also called knotted pile yarns, as will be explained later on in this description. The present disclosure relates to, among other things, a weaving machine and a method for manufacturing a hand-knotted carpet, for example such as a Persian carpet.

BACKGROUND

A hand-knotted carpet, for example such as a Persian carpet, consists of warp yarns and weft yarns, which together form a ground fabric, and of a large number of pile yarns that are joined to the warp yarns in such a way that each pile yarn comprises two end parts that project on one side of the ground fabric. This side is called the pile side and the other side is called the back of the carpet. All projecting end parts of the various pile yarns together form the pile of the carpet. The projecting end parts of the pile yarns are also called pile legs.

It is known to bind a pile yarn to the warp yarns by knotting the pile yarn manually, allowing a set of two or more warp yarns to run around a path such that the pile yarn is held sufficiently in the ground fabric, and in other words can only be pulled out of the ground fabric with great difficulty, for example by pulling on one of the pile legs. Thus, the pile yarn for example forms a closed loop round at least one of the warp yarns so that the pile yarn is sturdily anchored and is retained in the ground fabric. The path that the pile yarn follows is called "the knot path" in this patent application. The operation wherein a pile yarn is bound following a said knot path to a warp yarn is also called "knotting" and takes place manually in the known methods of weaving. The pile yarns that are bound to the ground fabric in this way are also called "knots". Thus, a carpet of this kind is called "a hand-knotted carpet".

In the manufacture of a hand-knotted carpet of this kind, alternately first a number of weft yarns are inserted manually in a weft direction into a shed formed between the warp yarns, and then a row of knots extending in the weft direction is formed manually by binding pile yarns to respective sets of warp yarns. The aforementioned "number of weft yarns" is usually one, two or three weft yarns. The knots in each row, the knot path of which will be described in detail hereunder, are also pushed manually firmly against the last weft yarn inserted, and each weft yarn is in each case also pushed firmly against the previously formed row of knots or the previously inserted weft yarn, so that weft yarns and rows of knots butt properly against each other.

The knot path depends on the knot selected. In the case of a so-called asymmetric knot, also called a Persian knot, the knot path of a pile yarn-comprising a first and a second pile yarn end part that extends respectively from one end and from the other end of the pile yarn-, relative to a set of two adjacent warp yarns (called the first and the second warp yarn hereinafter), may be defined as follows:

from the first pile yarn end part that projects above the ground fabric on the pile side and forms a first pile leg, the pile yarn runs firstly between the first and the second warp yarn towards the back of the carpet, is then turned round the first warp yarn, then runs on the side directed away from the first warp yarn, from the second warp yarn back to the pile side of the carpet, then runs on the pile side of the first warp yarn back to the projecting first pile yarn end part and then runs again between the first and the second warp yarn on the back of the carpet-crossing over itself so that the loop is closed-, is than turned round the second warp yarn, and then runs on the side directed away from the first warp yarn, from the second warp yarn back to the pile side of the ground fabric, to finish with the second pile yarn end part that projects on the pile side and forms a second pile leg.

When the warp yarns comprise successive sets of two successive warp yarns (called first and second warp yarns), a Persian knot may be formed with respect to each set. These knots then form a row that extends in the weft direction. Each knot forms two pile legs. Thus, the first pile yarn end part of each pile yarn forms a first pile leg that projects between the first and the second warp yarn, and the second pile yarn end part forms a second pile leg that projects between the second warp yarn and "another warp yarn" running next to the second warp yarn. This other warp yarn may then be the first warp yarn of an adjacent set of two warp yarns. Thus, per pile yarn, two pile legs are formed per set of two successive warp yarns.

Then a pile leg is formed between each two successive warp yarns. By alternately providing a row of such knots and a number of weft yarns towards the warp yarns, a Persian carpet of very high quality is obtained.

If, in a cross-section of the pile fabric with the pile side directed upwards, the aforementioned first warp yarn is located to the left of the second warp yarn, asymmetric knots are obtained that are open towards the left (see FIG. 1). If in contrast the first warp yarn is located in each case to the right of the second warp yarn, asymmetric knots are obtained that are open towards the right (see FIG. 2).

As stated, the manufacture of a carpet of this kind takes place substantially manually according to the existing methods, wherein shedding is carried out via a manually operated mechanism, and knotting and pushing down of the rows of knots, and insertion of weft yarns and the pushing down thereof, are also effected manually using hand tools. This method of weaving is of course very labour-intensive and proceeds very slowly.

In order to proceed more quickly, but to the detriment of the fineness and quality of the carpet, the knots are formed round a set of four warp yarns instead of round a set of two warp yarns, according to a so-called asymmetric Jufti knot. With this kind of knot, the knot path of a pile yarn-comprising a first and a second pile yarn end part that extends respectively from one end and from the other end of the pile yarn-, relative to a set of four successive warp yarns (called the first, the second, the third and the fourth warp yarn hereinafter), may be defined as follows:

from the first pile yarn end part that projects above the ground fabric on the pile side and forms a first pile leg (see FIG. 3), the pile yarn runs firstly between the second and the third warp yarn to the back of the ground fabric, then runs on the back from the third and the fourth warp yarn, then runs on the side directed away from the third warp yarn, from the fourth warp yarn back to the pile side of the carpet, then runs on the pile side from the fourth and the third warp yarn back to the projecting first pile yarn end part, and then runs again between the second and the third warp yarn to the back of the ground fabric-crossing over itself so that the loop is closed-, then runs on the back from the second and the first warp yarn, and then runs on the side directed away from the first warp yarn, from the second warp yarn back to the pile side of the carpet, to finish with the second pile yarn end part that projects on the pile side and forms a second pile leg.

According to an alternative knot path of an asymmetric Jufti knot (see FIG. 4), the pile yarn runs firstly from the first pile yarn end part between the second and the third warp yarn to the back of the ground fabric, then runs on the back from the third and the fourth warp yarn, then runs on the side directed away from the third warp yarn, from the fourth warp yarn back to the pile side of the carpet, then runs on the pile side back from the fourth, the third and the second warp yarn-thereby crossing the first pile yarn end part so that the loop is closed-, and then runs between the first and the second warp yarn to the back of the carpet, is then turned round the first warp yarn and then runs on the side directed away from the first warp yarn, from the second warp yarn back to the pile side of the carpet, to finish with the second pile yarn end part that projects on the pile side and forms a second pile leg.

Thus, the first pile yarn end part of each pile yarn forms a first pile leg that projects between the second and the third warp yarn of each set of four warp yarns, and the second pile yarn end part forms a second pile leg that projects between the first warp yarn and "another warp yarn" running next to the first warp yarn. This other warp yarn may then be a fourth warp yarn of an adjacent set of four warp yarns.

Thus, per pile yarn, two pile legs are formed per set of four successive warp yarns.

To date, the manufacture of a carpet with asymmetric Jufti knots is also effected manually. This method of weaving is still very labour-intensive and proceeds slowly.

SUMMARY

The term "pile yarn" is used in this patent application in the meaning of an end of textile yarn with two ends and a certain desired length, which is intended to be provided in a pile fabric for forming pile. The pile is formed by end parts of pile yarns, called pile legs, which project straight upwards or obliquely upwards on the upper side of the pile fabric—called the pile side—when the other side of the pile fabric—the back—lies in a more or less horizontal plane. A pile yarn may also be bound non-pile-forming in the fabric over a part of its length or over its whole length. A pile yarn is generally obtained by cutting off a certain length from a supply of textile yarn that is made available. A textile yarn that is used for forming pile is also often called a pile thread.

In this patent application the term pile yarn refers on the one hand to a cut-off pile yarn with the desired length, but on the other hand also to an end portion of a supply of pile yarn that has yet to be cut from this supply to form a pile yarn with the desired length.

One aim of the present disclosure is to rectify the drawbacks outlined above by providing a weaving machine and a method with which a carpet of this kind of almost the same quality can be manufactured more quickly, and manufacture can be automated at least partially.

This aim is achieved according to the present disclosure by providing a weaving machine for weaving pile fabrics with the features that are indicated in the first paragraph or in the second paragraph of this description, wherein, according to at least one embodiment of the present invention, the weaving machine is configured so that, in several pile forming cycles, with several sequences of a first and of a second warp yarn system which each comprise at least one warp yarn and are located in an original order, seen in the weft direction, on either side of a first gap, the warp yarns of at least one of the warp yarn systems are moved into the weft insertion mechanism until the warp yarn systems are located in a reversed order on either side of a second gap, a pile yarn is brought into a pull-through position wherein this extends through the second gap between the first and the second warp yarn system and projects with the two end parts on a respective edge from the warp yarns, then the warp yarns of at least one of the warp yarn systems are moved in the weft direction until at least one warp yarn of the first warp yarn system and at least one warp yarn of the second warp yarn system are back again in the original order on either side of a third gap, and an end part of the pile yarn located on the one edge of the warp yarns is pulled through the third gap so that the pile yarn extends via the third gap up to the other edge of the warp yarns and projects on the other edge.

Thus, the weaving machine is designed to bind pile yarns to the warp yarns automatically by forming a knot, wherein two pile-forming pile legs are formed per pile yarn, and wherein the pile yarn is bound sturdily to the warp yarns through the formation of an almost closed loop round at least one warp yarn. The knot is preferably an asymmetric knot, such as that illustrated in FIGS. 1 and 2, wherein each warp yarn system contains only one warp yarn, or an asymmetric Jufti knot as illustrated in FIGS. 3A and 3B.

The aforementioned aim is also achieved according to at least one embodiment of the present invention by providing a method for manufacturing pile fabrics with the features that are indicated in the third paragraph of this description, wherein, according to at least one embodiment of the present invention, in several pile forming cycles, for several sequences of a first and of a second warp yarn system which each comprise at least one warp yarn and are located in an original order, seen in the weft direction, on either side of a first gap, a) the warp yarns of at least one of the warp yarn systems are moved into the weft insertion mechanism so that the warp yarn systems are located in a reversed order on either side of a second gap, b) a pile yarn is brought into a pull-through position wherein this extends through the second gap between the first and the second warp yarn system and projects with the two end parts on a respective edge from the warp yarns, c) then the warp yarns of at least one of the warp yarn systems are moved in the weft direction until at least one warp yarn of the first warp yarn system and at least one warp yarn of the second warp yarn system are back again in the original order on either side of a third gap, and d) an end part of the pile yarn located on the one edge of the warp yarns is pulled through the third gap so that the pile yarn extends via the third gap up to the other edge of the warp yarns and projects on the other edge.

A method of this kind is simpler, proceeds faster, and can also be automated, at least partially, more easily than the known methods.

According to this method, pile yarns are bound to warp yarns by forming a knot, wherein two pile-forming pile legs are formed per pile yarn, and wherein the pile yarn is bound sturdily to the warp yarns through the formation of an almost closed loop round at least one warp yarn.

The knot is preferably an asymmetric knot or an asymmetric Jufti knot. Preferably each warp yarn system comprises one warp yarn. Other knots are also possible, for example by forming an almost closed loop round more than three warp yarns.

When the warp yarn systems are located in the original order, the gap between the warp yarns of the first warp yarn system and the warp yarns of the second warp yarn system is called the first gap. The gap between the warp yarns of the first warp yarn system and the warp yarns of the second warp yarn system in reversed order is called the second gap. The gap between at least one warp yarn of the first warp yarn system and at least one warp yarn of the second warp yarn system, which are back in the original order, is called the third gap.

The order of the first and the second warp yarn system refers to the situation wherein all warp yarns of the one warp yarn system are located on the same edge of all warp yarns of the other warp yarn system, and it means the mutual position, seen in the weft direction, of the first warp yarn system relative to the second warp yarn system. The mutual position of the first warp yarn system is then either "before", or "after" the second warp yarn system. If the first warp yarn system is located before or after the second warp yarn system then this order also applies to each warp yarn separately from the first warp yarn system relative to each warp yarn separately from the second warp yarn system.

The order of at least one warp yarn of the first warp yarn system and at least one warp yarn of the second warp yarn system, means the mutual position, seen in the weft direction, of these warp yarns. The mutual position of a warp yarn of the first warp yarn system is then either "before", or "after" the warp yarn of the second warp yarn system.

The warp yarns extend next to each other. Even if the warp yarns of the first and second warp yarn systems do not extend next to each other in one and the same plane, but in respective approximately parallel planes, or over a portion of their length are moved apart from each other in a transverse direction that is almost perpendicular to the plane or the planes in which the warp yarns substantially extend, there is mention of a first, a second and a third gap. The first and the second and the third gap may be seen as a passage extending transversely to the plane or the planes of the warp yarns between two warp yarns that belong to a different warp yarn system.

Preferably, the warp yarns of the successive warp yarn systems are firstly moved apart over at least a portion of their length in a transverse direction that is almost perpendicular to the plane or the planes in which the warp yarns originally extend, and the warp yarns of the first and/or of the second warp yarn system are then moved in the weft direction to reverse the order of the warp yarn systems.

Each pile yarn is bound to the warp yarns through the formation of a knot. Formation of a knot takes place by bringing, in a first phase of knot formation, a pile yarn into the second gap between two warp yarn systems in reversed order so that this pile yarn extends in said pull-through position through the second gap and projects on both edges of the warp yarns with a respective pile yarn end part, called a first and a second end part hereinafter. The pile yarn is then possibly still joined to a pile yarn supply, it being intended to cut this from the pile yarn in a later phase of knot formation. "The first end part of the pile yarn" thus refers in this patent application not only to the end part of a cut-off pile yarn that is located in the pull-through position on the one edge of the warp yarns, but also to the part of the pile yarn that is intended to form the first end part of the pile yarn, after cutting from the pile yarn.

In a second phase of knot formation, the warp yarn systems are brought back into their original order. Each pile yarn then preferably ends up in an interim position, wherein it follows a path which, relative to the warp yarns of the first and of the second warp yarn system, seen in a cross-section of the fabric in the process of formation, with the back directed upwards and a pile side directed downwards, is as follows:

either the pile yarn runs from its first end part that projects at the back, and is possibly still joined to a pile yarn supply, first on the right-hand side of the second warp yarn system to the pile side, is then turned to the left and runs to the pile side past each warp yarn of the second warp yarn system, then runs on the back past each warp yarn of the first warp yarn system, and finally runs on the left-hand side of the first warp yarn system to the pile side, to end there with the second end part, which projects on the pile side, or the pile yarn runs from its first pile yarn end, which projects at the back and is possibly still joined to a pile yarn supply, first on the left-hand side of the first warp yarn system to the pile side, then is turned to the right and runs on the pile side past each warp yarn of the first warp yarn system, then runs on the back past each warp yarn of the second warp yarn system, and finally runs on the right-hand side of the second warp yarn system to the pile side, to end there with the second end part, which projects on the pile side.

Finally, in a third phase of knot formation, the first end part that projects on the back is pulled through the third gap, so that the pile yarn forms a closed loop round each warp yarn of the first or the second warp yarn system, and the first end part also, just like the second end part, projects on the pile side of the fabric in the process of formation. If the pile yarn in the second phase is still joined to a pile yarn supply, it is preferably cut off of the pile yarn supply before the third phase of knot formation takes place.

When the warp yarns of the successive warp yarn systems have been moved apart earlier in said transverse direction, preferably after the third phase of knot formation these warp yarns are placed next to each other again in one and the same plane.

The knot is formed thereby and the pile yarn is held firmly in the ground fabric, because it forms a closed loop round each warp yarn of the first or the second warp yarn system. Both the first and the second pile yarn ends project on the pile side from the warp yarns, forming respective pile-forming pile legs. These pile legs project preferably over roughly the same length relative to the plane of the warp yarns.

If the first warp yarn system and the second warp yarn system each comprise one warp yarn, a Persian knot is formed. If a pile yarn then forms a closed loop round the warp yarn of the left warp yarn system of the first and the second warp yarn system, seen in a cross-section of the fabric in the process of formation with the pile side directed upwards, a Persian knot is obtained that is open towards the left. If a pile yarn then forms a closed loop round the warp yarn of the right-hand warp yarn system, seen in a cross-section of the fabric in the process of formation with the pile side directed upwards, a Persian knot is obtained that is open towards the right. If the first warp yarn system and the second warp yarn system each comprise two warp yarns or comprise one warp yarn and three warp yarns respectively or comprise three warp yarns and one warp yarn respectively, an asymmetric Jufti knot is formed.

Other knots may also be formed, wherein the number of warp yarns in the first warp yarn system and the number of warp yarns in the second warp yarn system is any other combination, for example such as one and two, two and one, two and three, three and two, three and four, four and three, one and four, four and one, respectively. Each pile yarn may for example then form a closed loop round three or more warp yarns.

To form the Jufti knot according to FIG. 3B, the first and the second warp yarn system must comprise one and three warp yarns, respectively. After the pile yarns have been inserted in the second gaps, the first and/or the second warp yarn systems must be moved in the weft direction so that they occupy a position relative to each other wherein two of the three weft yarns of the second warp yarn system are again located at the original edge of the only warp yarn of the first warp yarn system (thus in the original order). The first pile yarn end is then pulled through to the other edge of the carpet via the third gap between on the one hand the two warp yarns of the second warp yarn system, placed in the original order, and on the other hand the only warp yarn of the first warp yarn system.

In the method and the weaving machine according to at least one embodiment of the present invention, displacement of a warp yarn in the weft direction preferably means that the path of the warp yarn is altered in such a way that the warp yarn is only moved over a portion of its length.

Preferably, displacement of a warp yarn in the weft direction means that on the warp yarn that initially extends along a straight path line next to other warp yarns in the weaving machine, locally such a force is exerted, with a force component in the weft direction, that the warp yarn is pulled away locally from the straight path line in the weft direction, and as a result follows an altered angle-forming path between a first and a second place of the original path line. This altered path comprises a first path segment where a first warp yarn part, from the first place of the original path line, runs obliquely away from the original path line, a second path segment where a second warp yarn part is moved to the maximum extent in the weft direction from the original path line, and a third path segment where the one third warp yarn part again runs obliquely to the original path line until this is reached at the second place of the original path line.

The second warp yarn part is for example the warp yarn part on which said force is exerted. This second warp yarn part may have a very limited length, and may for example be limited to a curved portion of the warp yarn that forms the transition between the first and the second warp yarn part. The displacement of the one or more warp yarns of at least a number of the warp yarn systems in the weft direction preferably takes place in this way.

Reversing the order of two warp yarn systems then takes place for example by displacing all warp yarns of at least one of these warp yarn systems in the manner described above over a distance in the weft direction such that both the first warp yarn part and the second warp yarn part of each warp yarn of the one warp yarn system cross each warp yarn of the other warp yarn system, and so that the order of the two warp yarn systems—seen in the weft direction—is consequently reversed over a portion of the length of the warp yarns. The order of two warp yarn systems can of course also be reversed by displacing the warp yarns of both warp yarn systems, in opposite respective directions in the weft direction.

The weaving machine according to at least one embodiment of the present invention preferably comprises one or more warp yarn positioners, which are configured so that, in successive pile forming cycles, in each sequence of a first and of a second warp yarn system, in each case they change the order of the first and of the second warp yarn system by displacing each warp yarn of the first and/or of the second warp yarn system in the weft direction, preferably in the manner described in the four preceding paragraphs.

If two or more warp yarns are provided in one or both warp yarn systems of a sequence, the internal order of these warp yarns, namely the order of the warp yarns within the same warp yarn system, is preferably not changed by changing the order of the two warp yarn systems.

The order of the warp yarn systems and the internal order of warp yarns in each warp yarn system must be viewed in the weft direction. The weft direction is preferably approximately parallel to the plane or the planes in which the warp yarns of the successive warp yarn systems extend.

In a particular embodiment the weaving machine is configured for at least one of the warp yarn systems to be moved in the weft direction until all warp yarns of the first warp yarn system and all warp yarns of the second warp yarn system are back in the original order on either side of the third gap. Then for example a Persian knot is obtained, or a Jufti knot as shown in FIG. 3 B.

A first preferred embodiment of the weaving machine according to at least one embodiment of the present invention comprises a warp yarn positioning device, which is configured to move the warp yarns of the first warp yarn system and/or the warp yarns of the second warp yarn system at least over a portion of their length in a transverse direction that is approximately transverse to the warp yarn plane in which the warp yarns substantially extend, so that the warp yarns of the first warp yarn system and the warp yarns of the second warp yarn system of each sequence are moved relative to each other at least over a portion of their length in said transverse direction, and then to move the warp yarns of the first warp yarn system and/or the warp yarns of the second warp yarn system of each sequence relative to each other in the weft direction so as to reverse the order of the warp yarn systems, seen in the weft direction.

When the warp yarns of the first and of the second warp yarn systems of the various sequences are moved apart in the transverse direction, the warp yarns of each warp yarn system of a sequence can be displaced easily and unhindered in the weft direction past the warp yarns of the other warp yarn system of the sequence, to a position wherein the order of the first and of the second warp yarn system is reversed. In this position, the warp yarns of the one warp yarn system preferably cross the warp yarns of the other warp yarn system. As a result, the reversing of the order of the warp yarn systems can be carried out more easily and more reliably, and among other things with less risk of sticking.

Preferably, in each sequence, the warp yarns of the first and of the second warp yarn system are only moved apart in said transverse direction over a portion of their length.

Preferably, the warp yarns of the first and/or of the second warp yarn system of each sequence are moved in the transverse direction over a portion of their length. Moreover, a warp yarn, which initially extends along a straight path line next to other warp yarns in the weaving machine, is acted upon locally by such a force, with a force component in the transverse direction, that the warp yarn is pulled away locally from the straight path line in the transverse direction, and as a result follows an altered angle-forming path between a first and a second place of the original path line. This altered path comprises a first path segment where a first warp yarn part, from the first place of the original path line, runs obliquely away from the original path line, a second path segment where a second warp yarn part is moved away from the original path line to the maximum extent in the transverse direction, and a third path segment where the one third warp yarn part again runs obliquely towards the original path line until this is reached at the second place of the original path line.

The second warp yarn part is for example the warp yarn part on which said force is exerted. This second warp yarn part may have a very limited length, and may for example be limited to a curved portion of the warp yarn that forms the transition between the first and the second warp yarn part. The displacement of the one or more warp yarns of at least a number of the warp yarn systems in the transverse direction preferably takes place in this way.

Preferably it is only the warp yarn parts of the warp yarns displaced in the transverse direction that are then displaced in the weft direction in order to reverse the order of the warp yarn systems.

The weaving machine according to at least one embodiment of the present invention preferably comprises one or more movers that are configured so that, in successive pile forming cycles, in each sequence of a first and of a second warp yarn system, in each case each warp yarn of the first and/or of the second warp yarn system is moved in the transverse direction in the manner described in the preceding four paragraphs. Preferably the aforementioned warp yarn positioners are also configured for this.

In a second preferred embodiment of the weaving machine according to at least one embodiment of the present invention, the warp yarn positioning device comprises at least one first positioning body that is provided

- to be moved in said transverse direction and thereby displace the warp yarns of the first warp yarn system of each sequence in order to bring these warp yarns outside the warp yarn plane at least over a portion of their length, and
- to be moved in said weft direction and thereby displace the warp yarns of the first warp yarn system of each sequence so as to reverse the order of the warp yarn systems, seen in the weft direction.

Through the movement of the first positioning body, all warp yarns of the first warp yarn systems of each sequence may be displaced together, both in the transverse direction and in the weft direction. This makes simple, compact design of the weaving machine possible.

In a third preferred embodiment of the weaving machine according to at least one embodiment of the present invention, the warp yarn positioning device also comprises at least one second positioning body that is provided

- to be moved in said transverse direction and thereby also displace the warp yarns of the second warp yarn system of each sequence in order to bring these warp yarns outside the warp yarn plane at least over a portion of their length, and
- to be moved in said weft direction and thereby also displace the warp yarns of the second warp yarn system of each sequence so as to reverse the order of the warp yarn systems, seen in the weft direction.

Through the movement of the second positioning body, all warp yarns of the second warp yarn system of each sequence may also be displaced together, both in the transverse direction and in the weft direction. The combination of at least one first and at least one second positioning body allows the warp yarns of the first warp yarn systems and the warp yarns of the second warp yarn systems to be moved simultaneously in opposite directions, so that smaller movements suffice.

In a fourth preferred embodiment of the weaving machine according to at least one embodiment of the present invention, each first positioning body is provided on the one edge of the warp yarns, and configured to move the warp yarns of the first warp yarn system in the transverse direction at least over a portion of their length so that on the one edge of the warp yarns they are brought outside the warp yarn plane, and each second positioning body is provided on the other edge of the warp yarns, and configured to displace the warp yarns of the second warp yarn system in the transverse direction at least over a portion of their length so that on the other edge of the warp yarns they are brought outside the warp yarn plane.

Each first and second positioning body is then preferably also configured to be moved in said weft direction and thereby also displace the warp yarns of the first, or respectively of the second warp yarn system of each sequence so as to reverse the order of the warp yarn systems, seen in the weft direction.

In a fifth preferred embodiment of the weaving machine according to at least one embodiment of the present invention, at least one first positioning body and/or at least one second positioning body comprises a row of warp yarn passages.

In this weaving machine, a number of warp yarns preferably extend through a respective warp yarn passage of a first or a second positioning body. In this simple manner, the various warp yarns are kept well separated from each other with a fixed spacing, while these warp yarns are also easily movable in the transverse direction and in the weft direction by moving the associated first or second positioners.

In a sixth preferred embodiment of the weaving machine according to at least one embodiment of the present invention, at least one first positioning body and/or at least one second positioning body comprise a number of fingers provided next to each other with spacing, in which at least one warp yarn passage is provided.

Preferably, one warp yarn passage is provided in each finger. Each finger preferably has a width that is less than the spacing between two warp yarns running next to each other in the weaving machine. All warp yarns associated with a positioning body preferably extend through a respective warp yarn passage of the positioning body in question. The fingers preferably extend roughly parallel next to each other.

The first and the second positioning bodies are preferably provided opposite each other on either side of the warp yarns. Preferably, the warp yarns of a number of first warp yarn systems run through warp yarn passages that are provided in respective fingers of the first positioning body. The warp yarns of a number of second warp yarn systems then run through warp yarn passages that are provided in respective fingers of the second positioning body. Seen in order in the weft direction, alternately a finger of the first positioning body and a finger of the second positioning body are thus provided. The fingers of the first positioning body are preferably located between the fingers of the second positioning body and vice versa.

A seventh preferred embodiment of the weaving machine according to at least one embodiment of the present invention is configured so that, in each pile forming cycle, at least one pile yarn is joined to a number of warp yarns by forming a knot, wherein each knot is located between the edge of the fabric in the process of formation and at least one positioning body, and the positioning body is configured to be moved, in the direction in which the warp yarns extend next to each other, towards said edge in order to move each knot in this direction until it almost abuts against said fabric edge.

In an embodiment where at least the warp yarns round which the closed loops are formed during knot formation extend through a respective warp yarn passage in a positioning body, the positioning body may be moved in order to push against the knots with the side thereof directed towards the knots, and thus exert a force on these knots in order to move them towards the edge of the fabric in the process of formation—called the fabric edge hereinafter—and/or to push them against the fabric edge. This proceeds very efficiently and can be carried out easily and simply.

In a weaving machine of this kind, the same warp yarn positioning device provides not only the positioning of the warp yarns for knotting the pile yarns, but also the pressing of the knots against the fabric edge.

An eighth preferred embodiment of the weaving machine according to at least one embodiment of the present invention is configured so that in each weft insertion cycle, in each case the weft insertion mechanism inserts at least one weft yarn in a weft direction in a shed formed between warp yarns between the edge of the fabric in the process of formation and at least one positioning body, wherein this positioning body is configured to be moved in the direction in which the warp yarns extend next to each other towards said edge in order to displace each inserted weft yarn in this direction until it almost abuts against said edge.

In an embodiment wherein at least a number of the warp yarns extend through a respective warp yarn passage, the positioning body can be moved so as to push against the weft yarns with the side thereof directed towards the weft yarns, and thus exert a force on these weft yarns in order to displace them towards the fabric edge and/or push them against the fabric edge. This also proceeds very efficiently and can also be carried out easily and simply.

In a weaving machine of this kind, the same warp yarn positioning device provides not only the positioning of the warp yarns for knotting the pile yarns, but also pressing the inserted weft yarns against the fabric edge.

In a ninth preferred embodiment of the weaving machine according to at least one embodiment of the present invention, the warp yarn positioning device is configured so that, in several weft insertion cycles, the warp yarns of the first warp yarn system of each sequence and/or the warp yarns of the second warp yarn system of each sequence are moved in said transverse direction at least over a portion of their length, to form in each case a shed between these warp yarns.

In a weaving machine of this kind, the same warp yarn positioning device provides not only the positioning of the warp yarns for knotting the pile yarns, but it also functions as shedding device for forming the shed between the warp yarns in the successive weft insertion cycles.

The weaving machine according to at least one embodiment of the present invention comprises, in a tenth preferred embodiment, a cutting device, which is configured to cut off from a pile yarn supply, in several pile forming cycles, each pile yarn that is to be bound to the ground fabric.

This cutting device comprises for example a holder that is configured to hold the end portion of a pile yarn supply and a cutter, for example such as a knife, in order to cut through the pile yarn. The weaving machine is configured to bring the pile yarn first into a cutting position relative to the cutter, so that the cut-off pile yarn has the desired length. This length is of course important for obtaining the desired pile height on the pile fabric.

In an eleventh preferred embodiment, the weaving machine according to at least one embodiment of the present invention comprises at least one set of a pile yarn feeder and an associated pile yarn receiver, wherein the pile yarn feeder is configured so that, in several pile forming cycles, a pile yarn is held in a first feed position on the one edge of the warp yarns, and wherein the pile yarn receiver is configured so that, in several pile forming cycles, the pile yarn held in the first feed position on the other edge of the warp yarns is pulled through a respective second gap between two warp yarn systems in reversed order and is brought into said pull-through position, and then, after at least one warp yarn of the first warp yarn system and at least one warp yarn of the second warp yarn system are put back in the original order, the end part of the pile yarn located on the one edge of the warp yarns is pulled through via the third gap so that this end part extends via the third gap up to the other edge of the warp yarns and projects on the other edge, and so that each pile yarn is bound to the warp yarns by formation of a knot and comprises two pile legs projecting on the other edge of the warp yarns.

In a twelfth preferred embodiment the weaving machine according to at least one embodiment of the present invention comprises at least one set of a pile yarn feeder and an associated pile yarn receiver, wherein the pile yarn feeder is configured so that, in several pile forming cycles, a pile yarn is held in a second feed position, wherein this pile yarn extends from the one edge of the warp yarns through a second gap between two warp yarn systems in reversed order up to the other edge of the warp yarns, and wherein the pile yarn receiver is configured so that, in several pile forming cycles, the pile yarn held in the second feed position is gripped on the other edge of the warp yarns and is brought into or held in the pull-through position, and then, after the warp yarn systems are put back in the original order, the end part of the pile yarn located on the one edge of the warp yarns is pulled through said third gap so that this end part extends through the first gap up to the other edge of the warp yarns and projects on the other edge, and so that each pile yarn is bound to the warp yarns by formation of a knot and comprises two pile legs projecting on the other edge of the warp yarns.

It is worth emphasizing that, particularly in relation to the eleventh and the twelfth preferred embodiments, the term "pile yarn" refers not only to a cut-off pile yarn with the desired length, but also to an end portion of a pile yarn supply that still has to be cut off of this supply to form a pile yarn with the desired length. In a specific embodiment of the weaving machine, an end portion of a pile yarn supply that has yet to be cut off is first brought into the pull-through position and is later cut off of the pile yarn supply.

In a thirteenth preferred embodiment of the weaving machine, the pile yarn feeder of the twelfth especially preferred embodiment comprises an elongated hollow feed-through body that forms a passage extending in the longitudinal direction for a pile yarn, wherein the pile yarn feeder is configured to be placed in a first position, wherein the feed-through body extends from the one edge of the warp yarns through said second gap up to the other edge of the warp yarns, so that a pile yarn extending through the passage of the feed-through body is held in the second feed position, wherein the pile yarn receiver is configured to retain the pile yarn held in the second feed position, and wherein the pile yarn feeder is configured so that, while the pile yarn is retained, it is moved from said first position to a second position wherein the feed-through body no longer extends through the gap and is located entirely on the one edge of the warp yarns.

A hollow feed-through body of this kind is particularly suitable for producing a pile fabric according to at least one embodiment of the present invention, wherein combined pile yarns, such as among other things grass pile yarns for forming artificial grass and the like, are provided.

In the above embodiments, which comprise at least one set of a pile yarn feeder and an associated pile yarn receiver, each pile yarn feeder is preferably configured to hold or to bring a pile yarn in the feed position in each pile forming cycle with a yarn end that is within the range of the pile yarn receiver interacting therewith.

In a fourteenth preferred embodiment of the weaving machine, said pile yarn receiver is also configured to be moved between a first and a second position in a transverse direction that is approximately transverse to the warp yarn plane in which the warp yarns substantially extend, in order to receive, in the first position, a yarn end of a pile yarn brought into the first or the second feed position and to bring this pile yarn, through the movement of the pile yarn receiver to the second position, into said pull-through position.

In a fifteenth preferred embodiment the weaving machine according to at least one embodiment of the present invention comprises, for at least one set of a pile yarn feeder and an associated pile yarn receiver, a row of pile threads or pile yarns with mutually different appearance-determining properties, and the pile yarn feeder is configured to bring selectively, in several pile forming cycles, a predetermined pile yarn of the series into the first or the second feed position, wherein the first feed position is applicable in relation to the eleventh preferred embodiment and the second feed position is applicable in relation to the twelfth or the thirteenth preferred embodiment.

The aforesaid appearance-determining property is for example the colour or the thickness of the respective pile yarn or the material from which it is manufactured.

Preferably, the pile yarn feeder comprises a positionable holder body comprising a first and a second holder some distance apart for holding respectively a first and a second pile yarn, which differ as regards appearance, the holder body is selectively positionable in a first and a second position relative to the associated pile yarn receiver, in order to bring either the first pile yarn or the second pile yarn into the first or the second feed position relative to the pile yarn receiver. The holder body may also comprise three or more holders for holding respective pile yarns with a mutually different appearance, and may be selectively positionable in a corresponding number of positions relative to the associated pile yarn receiver so as to bring, in each pile forming cycle, one of these pile yarns into the first or the second feed position relative to the pile yarn receiver. The first feed position is applicable in relation to the eleventh preferred embodiment and the second feed position in relation to the twelfth or the thirteenth preferred embodiment.

The pile yarn is preferably selected in accordance with a predetermined weaving pattern in order to obtain a pile fabric with the desired appearance.

In a sixteenth preferred embodiment of the weaving machine, said pile yarn receiver comprises a first pile yarn rapier, which is configured to grip the pile yarn brought into the first or the second feed position, and a second pile yarn rapier, which is configured to grip in each case the end part of this pile yarn located on the one edge of the warp yarns and to pull it through said first gap.

The weaving machine comprises, in a seventeenth preferred embodiment, a row of warp yarns running next to each other, which extend substantially in a warp yarn plane, and which comprise several sequences of a first and second warp yarn system, wherein each warp yarn system comprises at least one warp yarn, and wherein the warp yarn systems are located in an original order, seen in the weft direction, on either side of a first gap.

Preferably, the warp yarns comprise several sequences of first and second warp yarn systems following each other directly, so that the warp yarns comprise a succession of alternately a first and a second warp yarn system. Preferably only one warp yarn is provided in each warp yarn system so that a pile fabric is obtained with pile yarns that are bound to the warp yarns by Persian knots, or the first and the second warp yarn systems each comprise two warp yarns or respectively one warp yarn and three warp yarns or respectively three warp yarns and one warp yarn, so that a pile fabric is obtained with pile yarns that are bound by Jufti knots to the warp yarns.

In an eighteenth preferred embodiment, which also comprises the features of the sixteenth and the seventeenth preferred embodiments, the weaving machine comprises at least one first positioning body that is placed on the one edge of the warp yarns and is movable in a transverse direction that is approximately transverse to the warp yarn plane, in order to bring the warp yarns of the first warp yarn systems, over a portion of their length, on the one edge outside the warp yarn plane, and is movable in the weft direction in order to move the warp yarns of the first warp yarn systems over a portion of their length in the weft direction, to reverse the order of the warp yarn systems, and at least one second positioning body that is placed on the other edge of the warp yarns and is movable in said transverse direction in order to bring the warp yarns of the second warp yarn systems, over a portion of their length, to the other edge outside the warp yarn plane, and is movable in the weft direction in order to move the warp yarns of the second warp yarn systems over a portion of their length in the weft direction, so as to reverse the order of the warp yarn systems, and the weaving machine is configured to carry out the following steps automatically during several pile forming cycles:

a) move the first and the second positioning bodies away from each other in the transverse direction in order to bring the first and the second warp yarns outside the warp yarn plane respectively on the one edge and on the other edge of the warp yarn plane, b) move the first and the second positioning bodies relative to each other in the weft direction so that the order of the warp yarn systems is reversed, c) operate the first pile yarn rapier in order to grip the yarn end of the pile yarn placed in the first or the second feed position and bring it into or hold it in the pull-through position, d) move the first and the second positioning bodies relative to each other in the weft direction so that at least one warp yarn of the first warp yarn system and at least one warp yarn of the second warp yarn system are back in the original order, on either side of a third gap, e) operate the second pile rapier to pull the end part of the pile yarn located on the one edge of the warp yarns through the third gap, so that this end part extends via the third gap up to the other edge of the warp yarns and projects on the other edge.

In a nineteenth and most preferred embodiment, the weaving machine comprises the features of the eighteenth preferred embodiment and it is additionally also configured to, during several weft insertion cycles a) move the first and the second positioning bodies away from each other in the transverse direction to bring the warp yarns of the first warp yarn system and the warp yarns of the second warp yarn system outside the warp yarn plane respectively on the one edge and on the other edge of the warp yarn plane, so as to form a shed between the warp yarns of the first warp yarn systems and the warp yarns of the second warp yarn systems, b) operate the weft insertion mechanism to insert one or more weft yarns in the shed in the weft direction.

The features of the method according to at least one embodiment of the present invention have been indicated above. When applying this method, preferably, in step c, at least one of the warp yarn systems is moved in the weft direction until all warp yarns of the first warp yarn system and all warp yarns of the second warp yarn system are back in the original order on either side of the third gap.

Preferably, first the warp yarns of the first warp yarn system and/or the warp yarns of the second warp yarn system are moved, at least over a portion of their length, in a transverse direction that is approximately transverse to the warp yarn plane in which the warp yarns substantially extend, so that the warp yarns of the first warp yarn system and the warp yarns of the second warp yarn system of each sequence are displaced relative to each other, at least over a portion of their length, in said transverse direction, and then the warp yarns of the first warp yarn system and/or the warp yarns of the second warp yarn system of each sequence are moved relative to each other in the weft direction in order to reverse the order of the warp yarn systems, seen in the weft direction.

Moreover, it is also preferred, in each weft insertion cycle, to move the warp yarns of the first and of the second warp yarn system at least over a portion of their length in a transverse direction that is approximately transverse to the warp yarn plane in which the warp yarns substantially extend, so that the warp yarns of the first warp yarn system and the warp yarns of the second warp yarn system of each sequence are displaced relative to each other at least over a portion of their length in said transverse direction, so as to form a shed between the warp yarns, after which at least one weft yarn is brought into the shed in a weft direction.

For implementing this method, it is finally also particularly advantageous to displace the warp yarns of the first and of the second warp yarn system in the transverse direction so that these are brought outside the warp yarn plane respectively on the one edge and on the other edge of the warp yarn plane.

BRIEF DESCRIPTION OF THE DRAWINGS

The features of the invention are now explained in more detail on the basis of the following description of a weaving machine and a method according to embodiments of the present invention.

It should be made clear that the description given hereunder cannot form a basis for a limiting interpretation of the scope of protection, which is determined by the appended claims, nor for any limitation of the field of application of the present invention.

Figure 1:
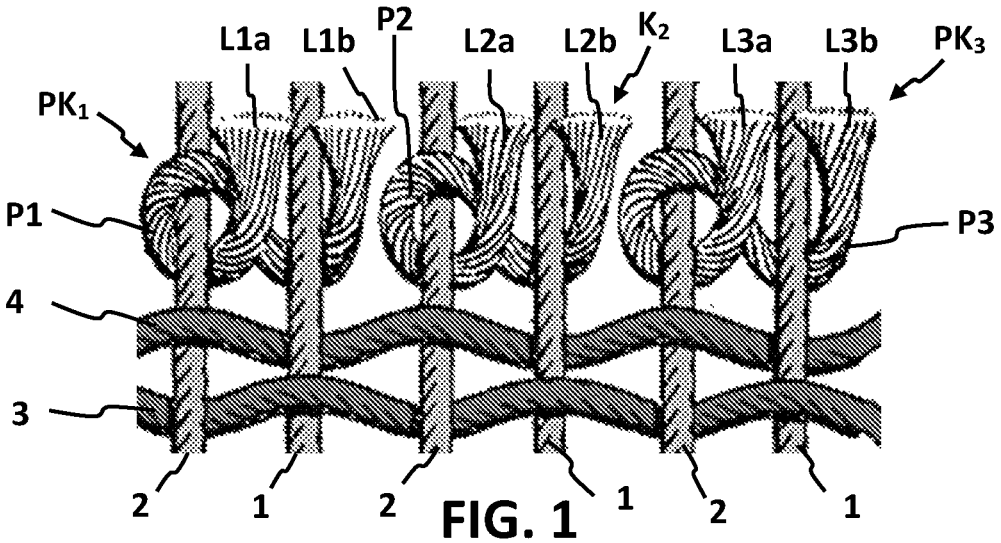
Figure 2:
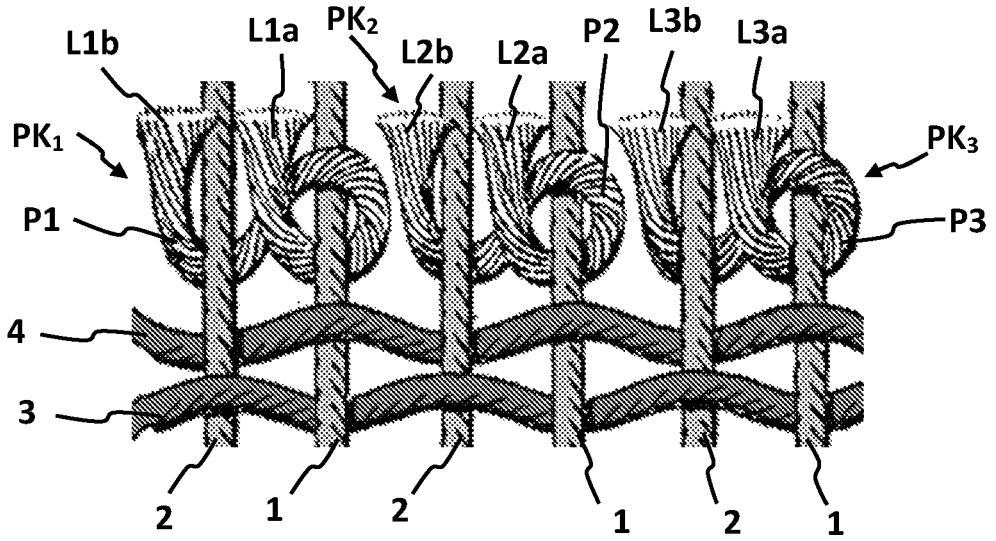
Figure 3A:
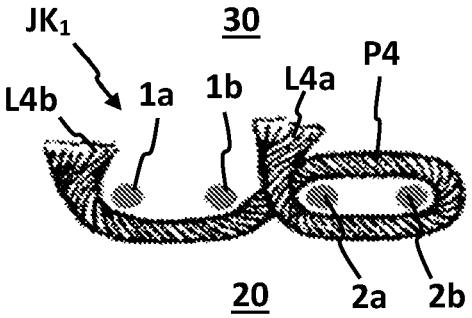
Figure 3B:
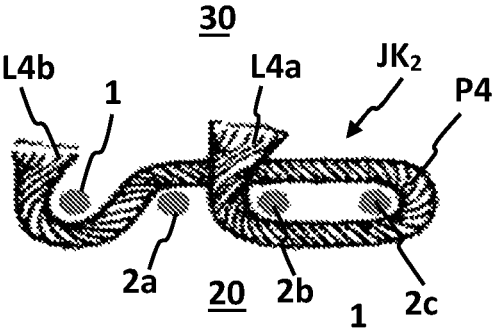
Figure 6:
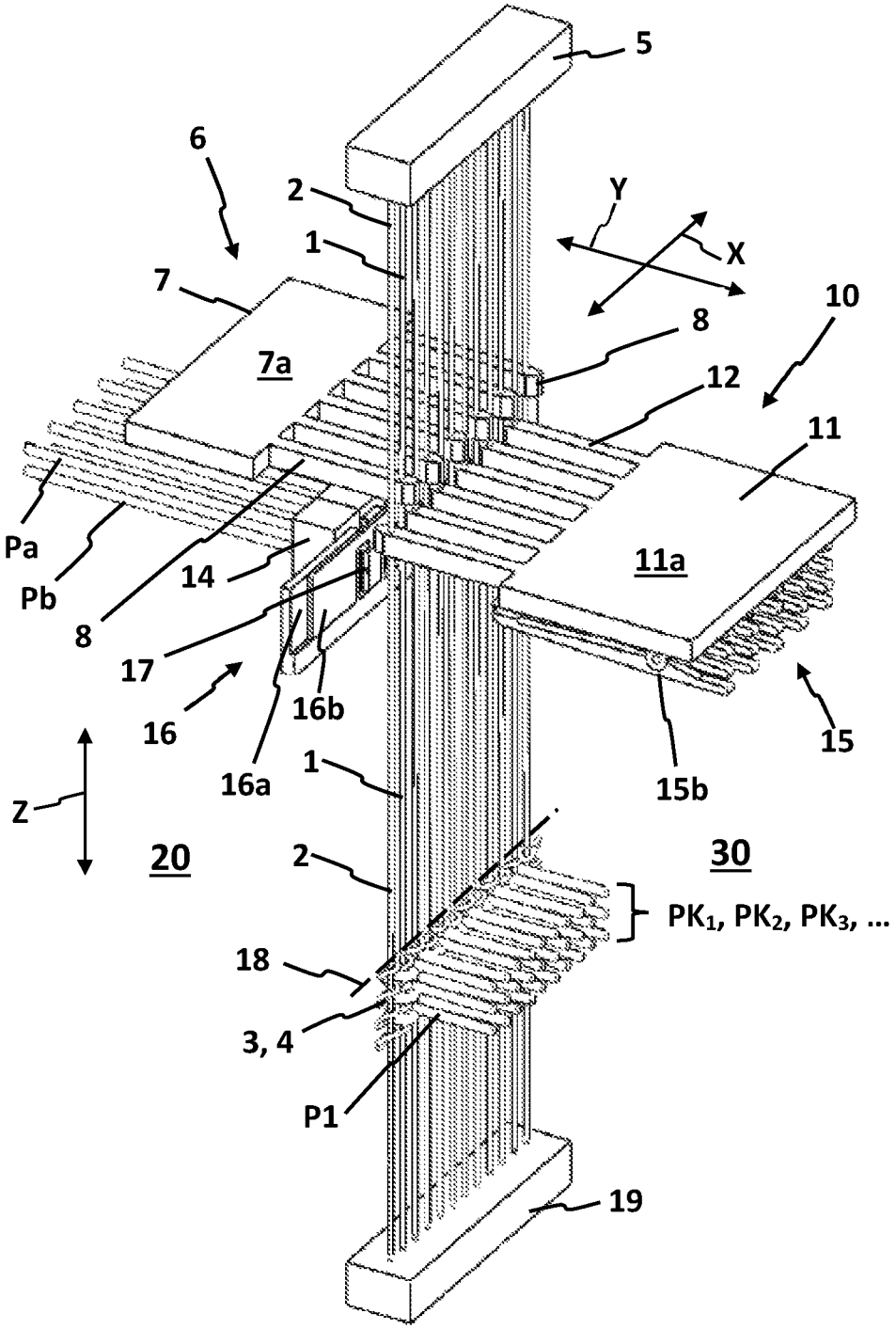
Figure 7:
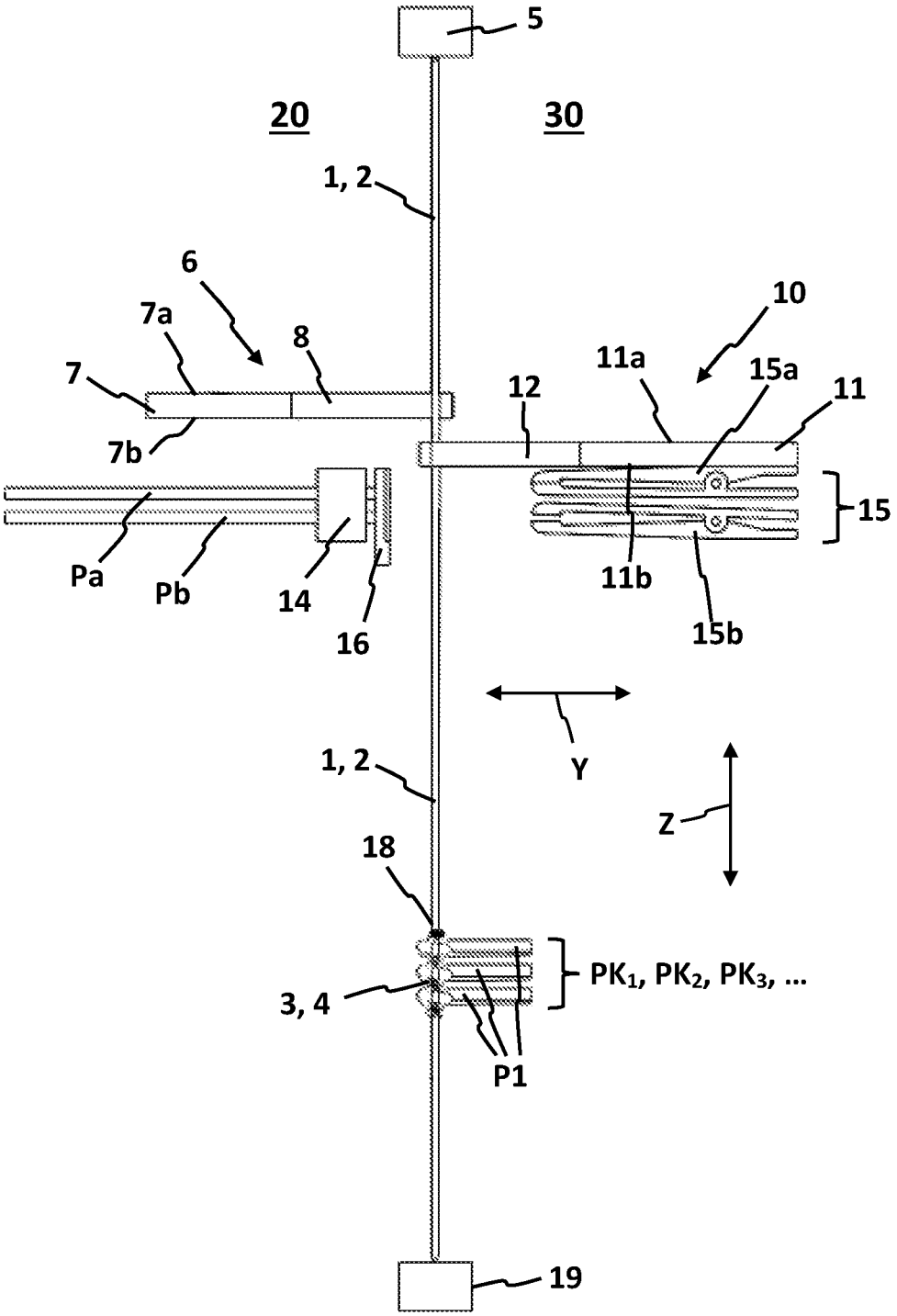
Figure 8:
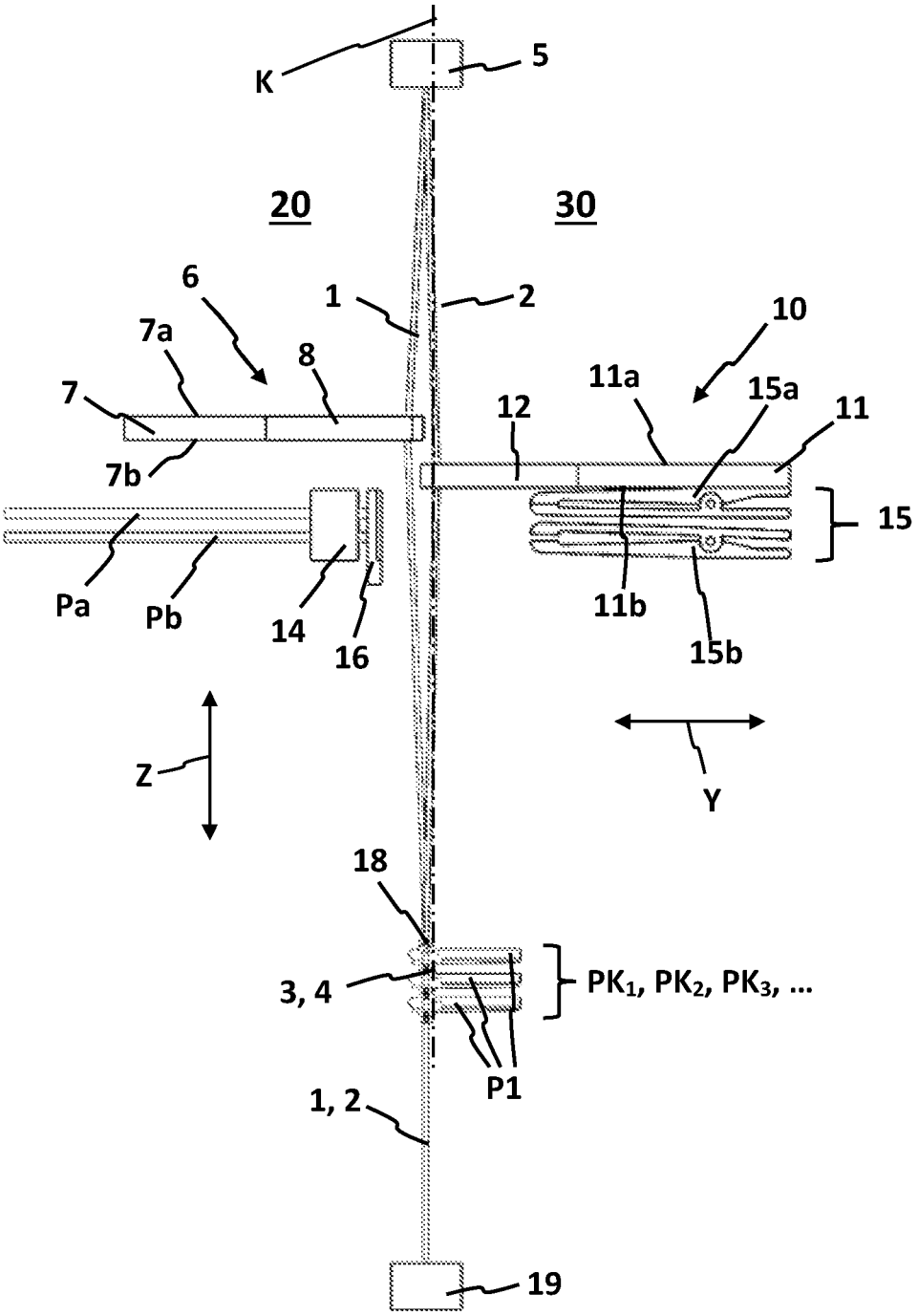
Figure 9:
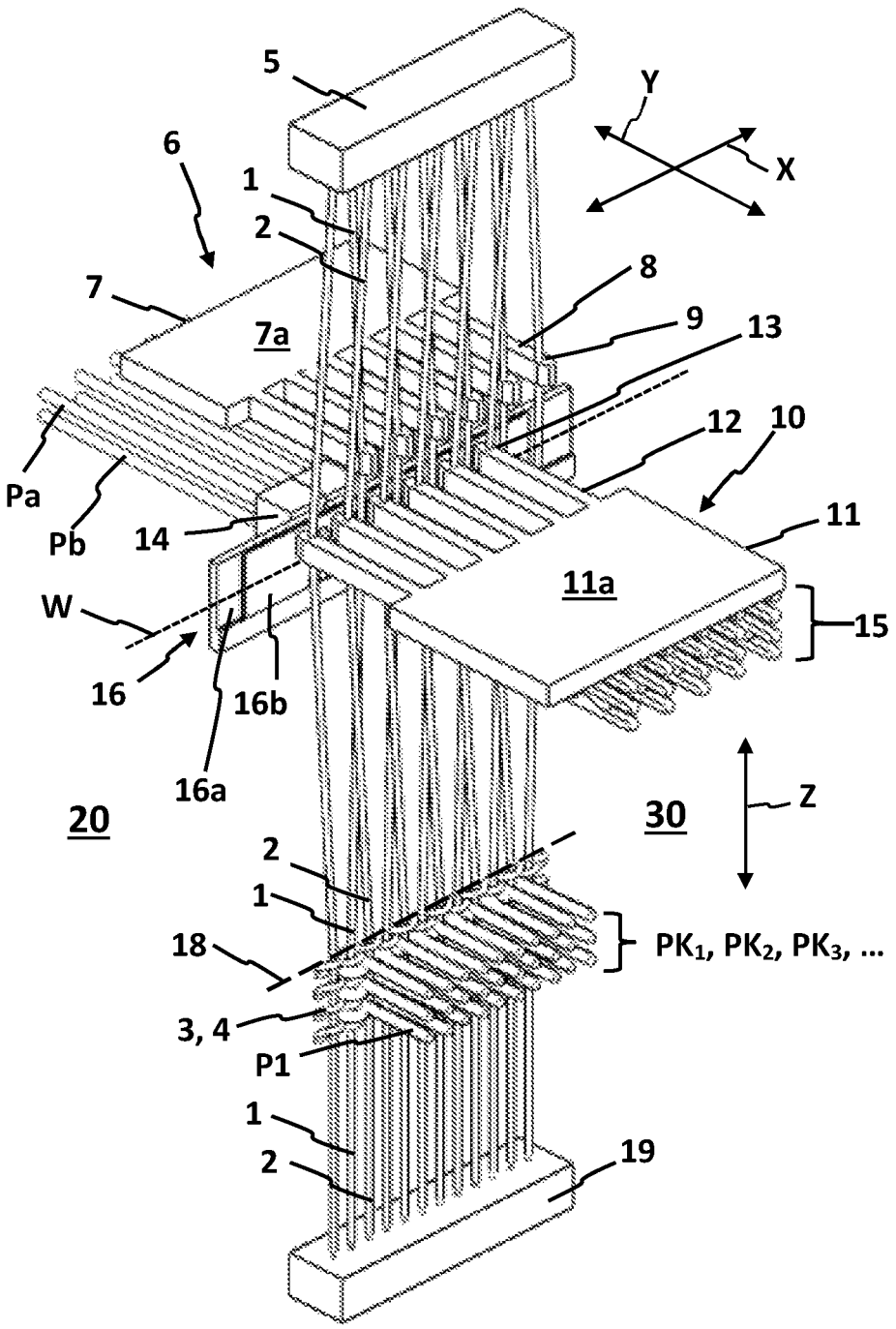
Figure 10:
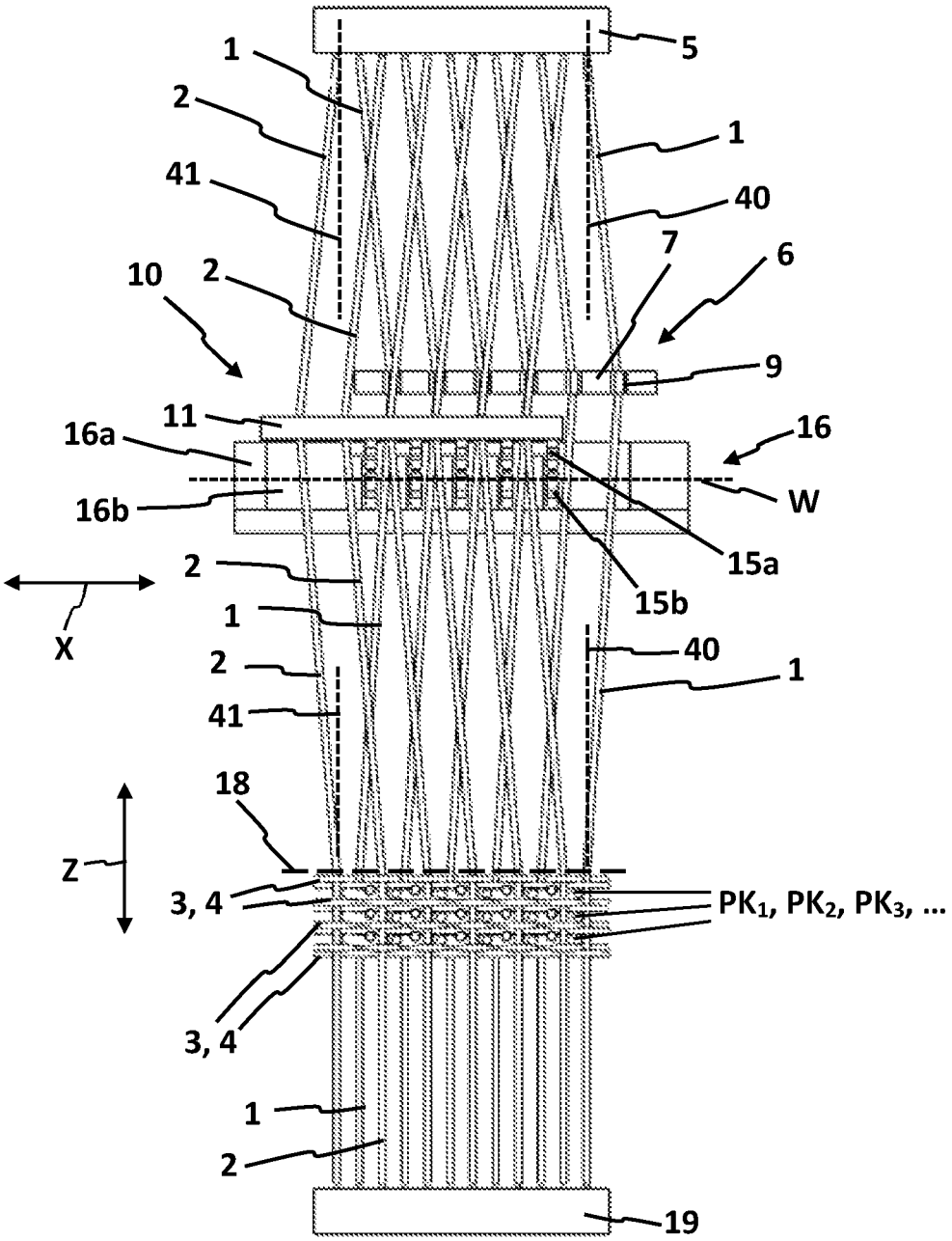
Figure 11:
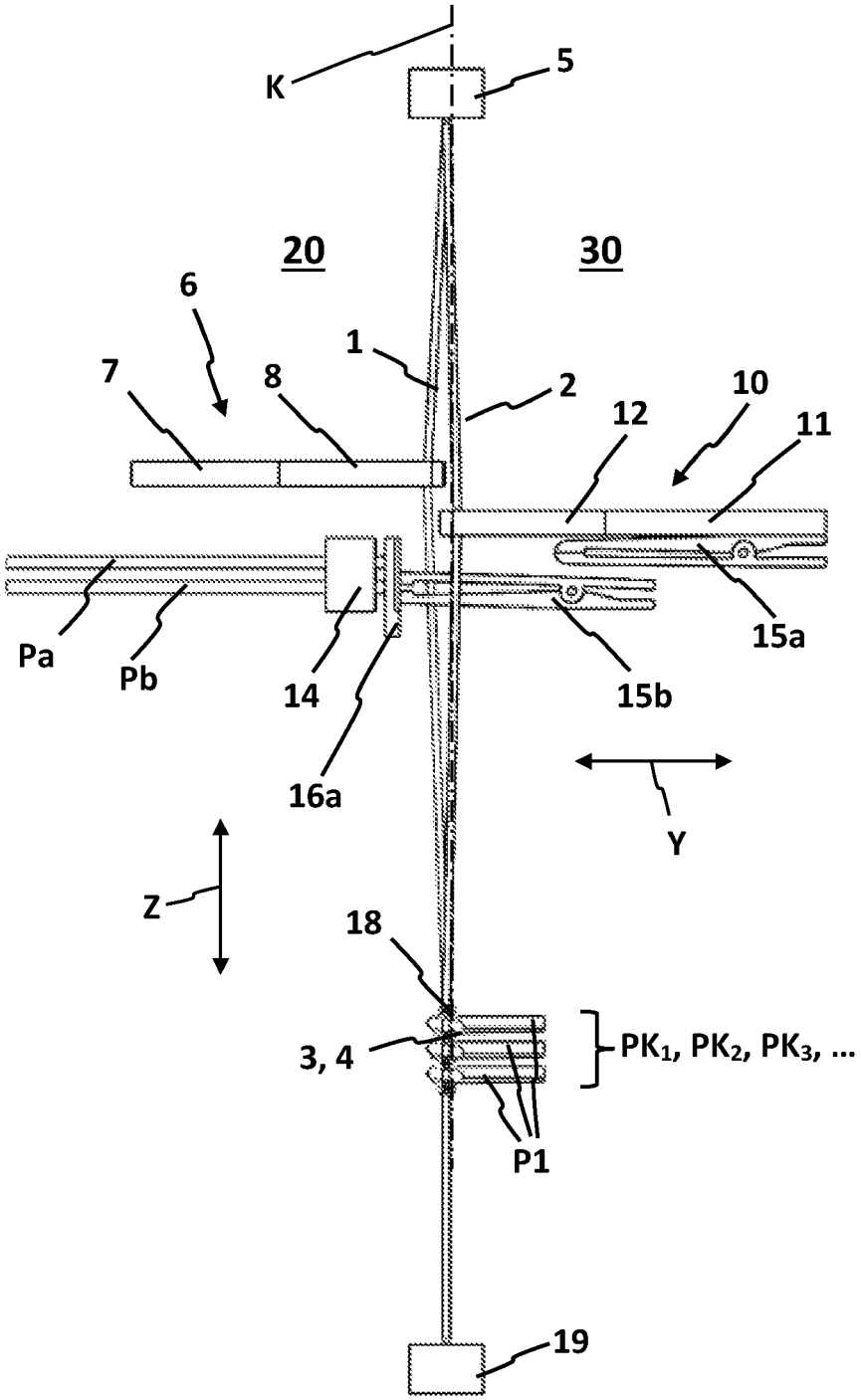
Figure 12:
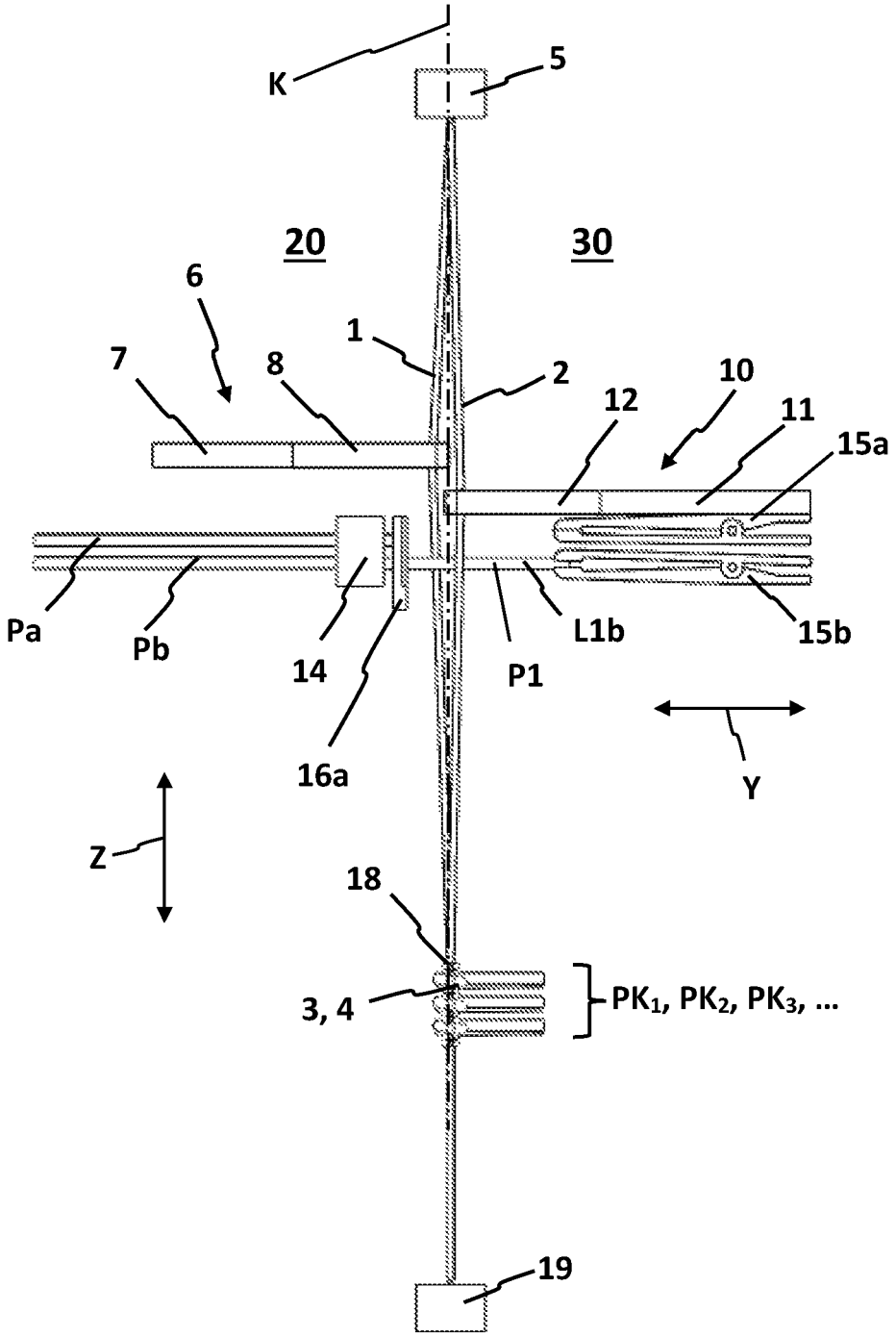
Figure 13:
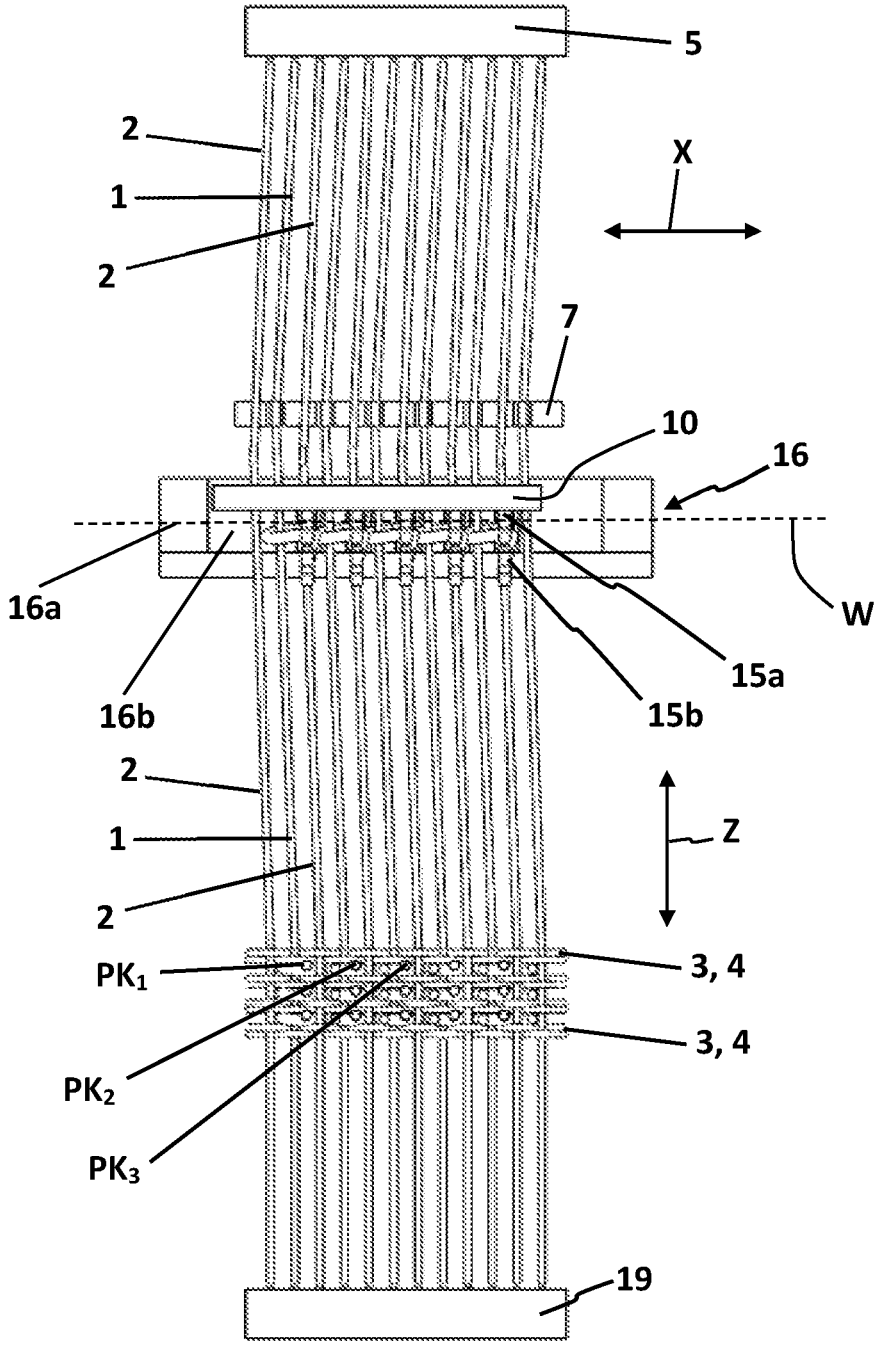
Figure 14:
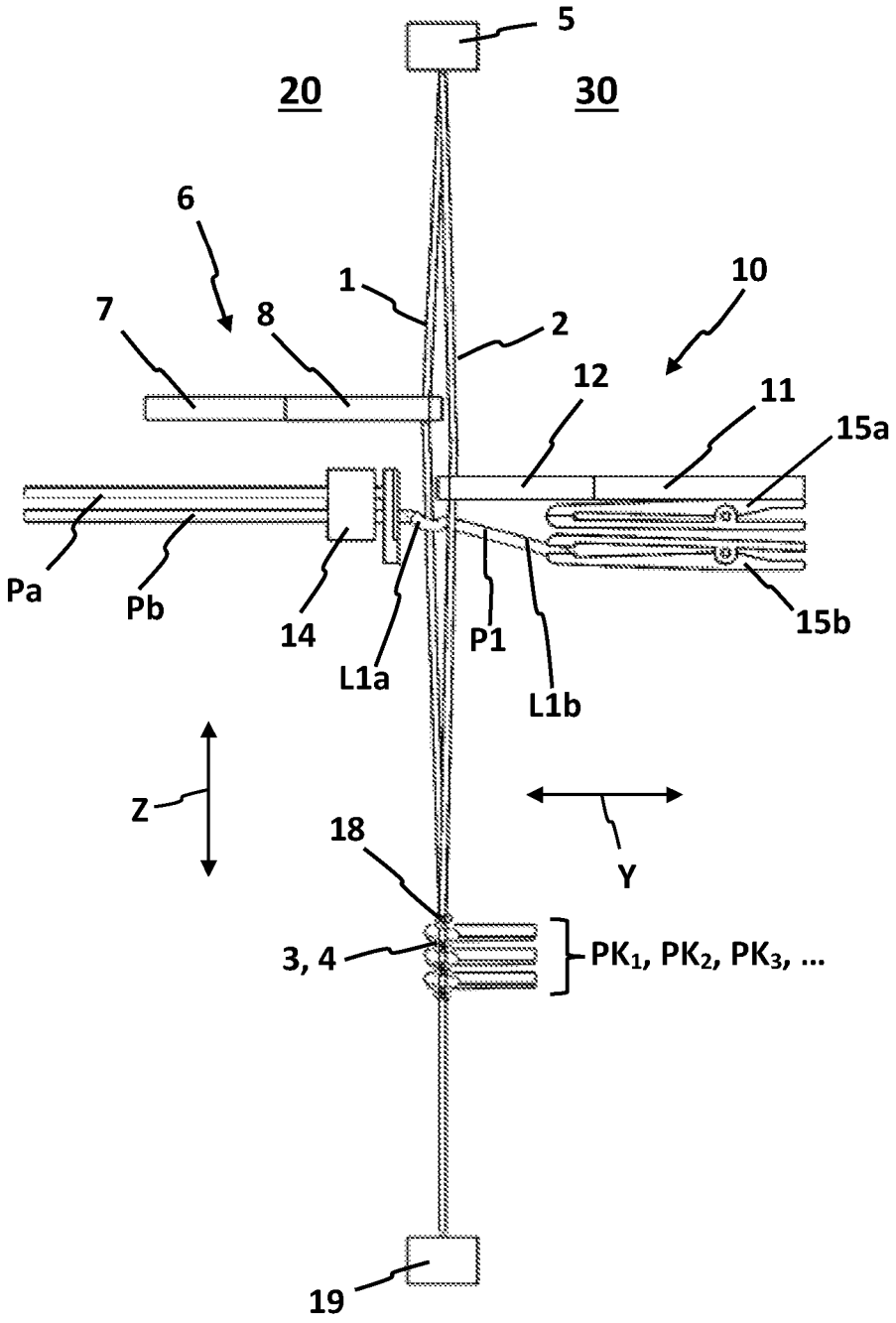
Figure 15:
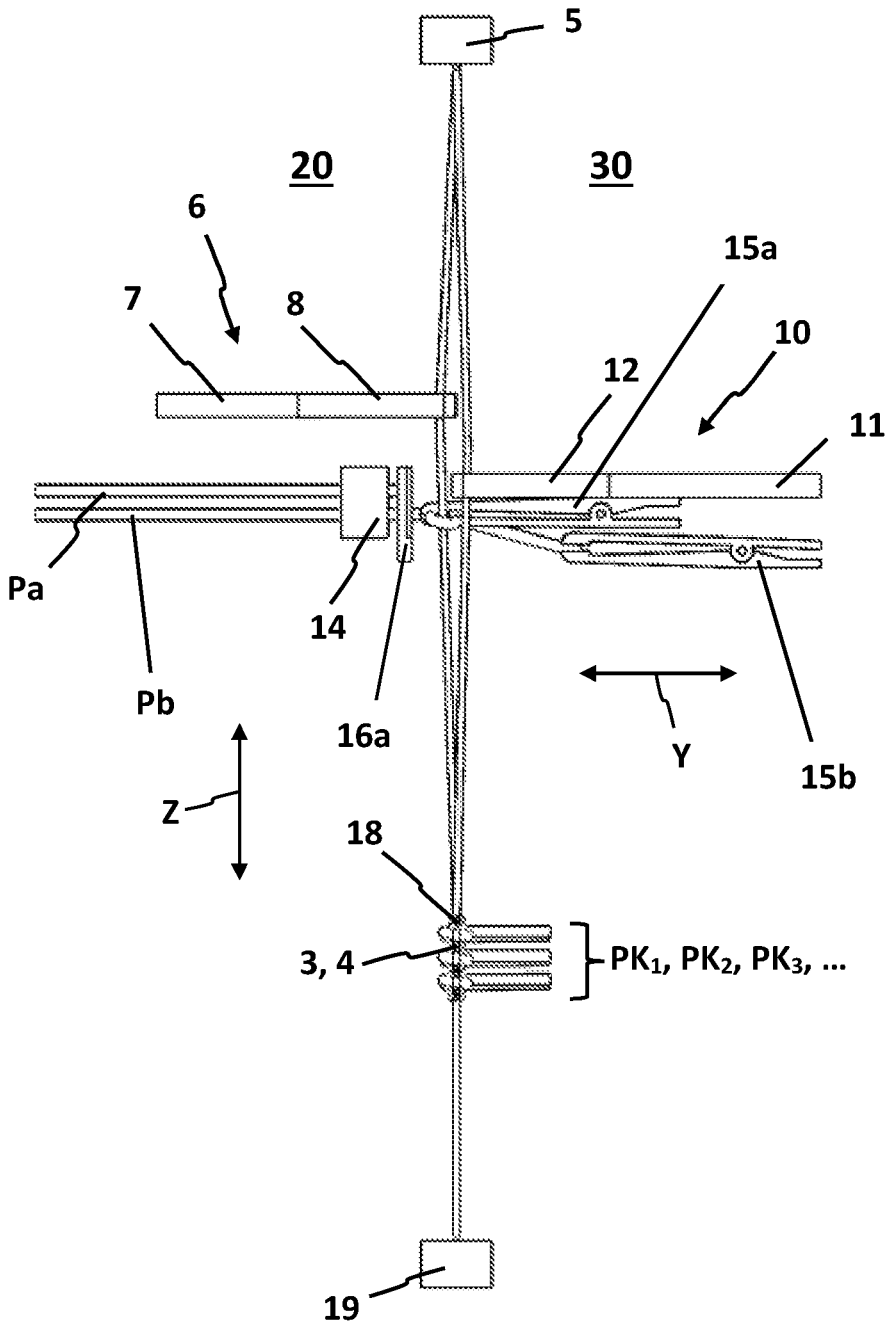
Figure 16:
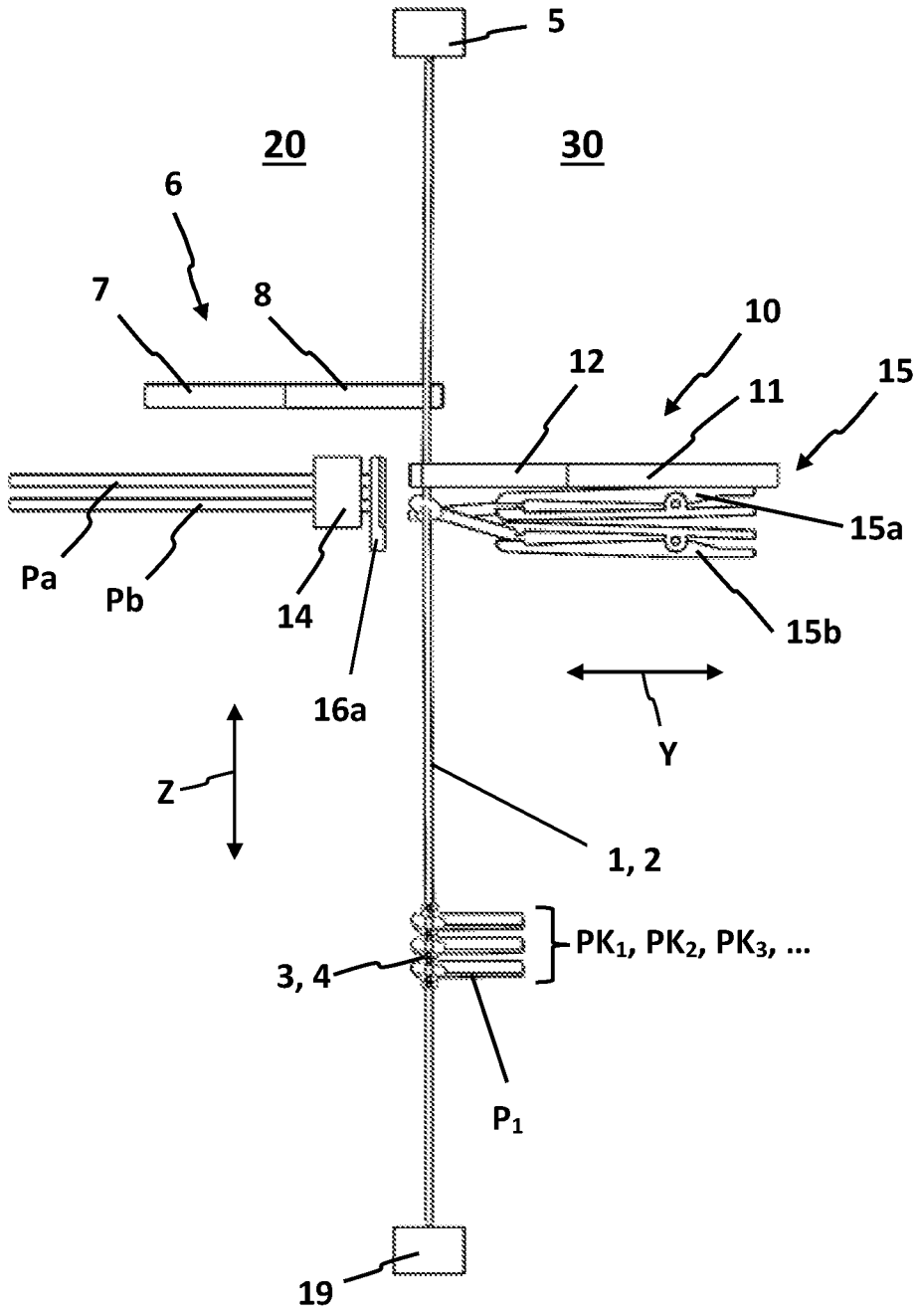
Figure 17:
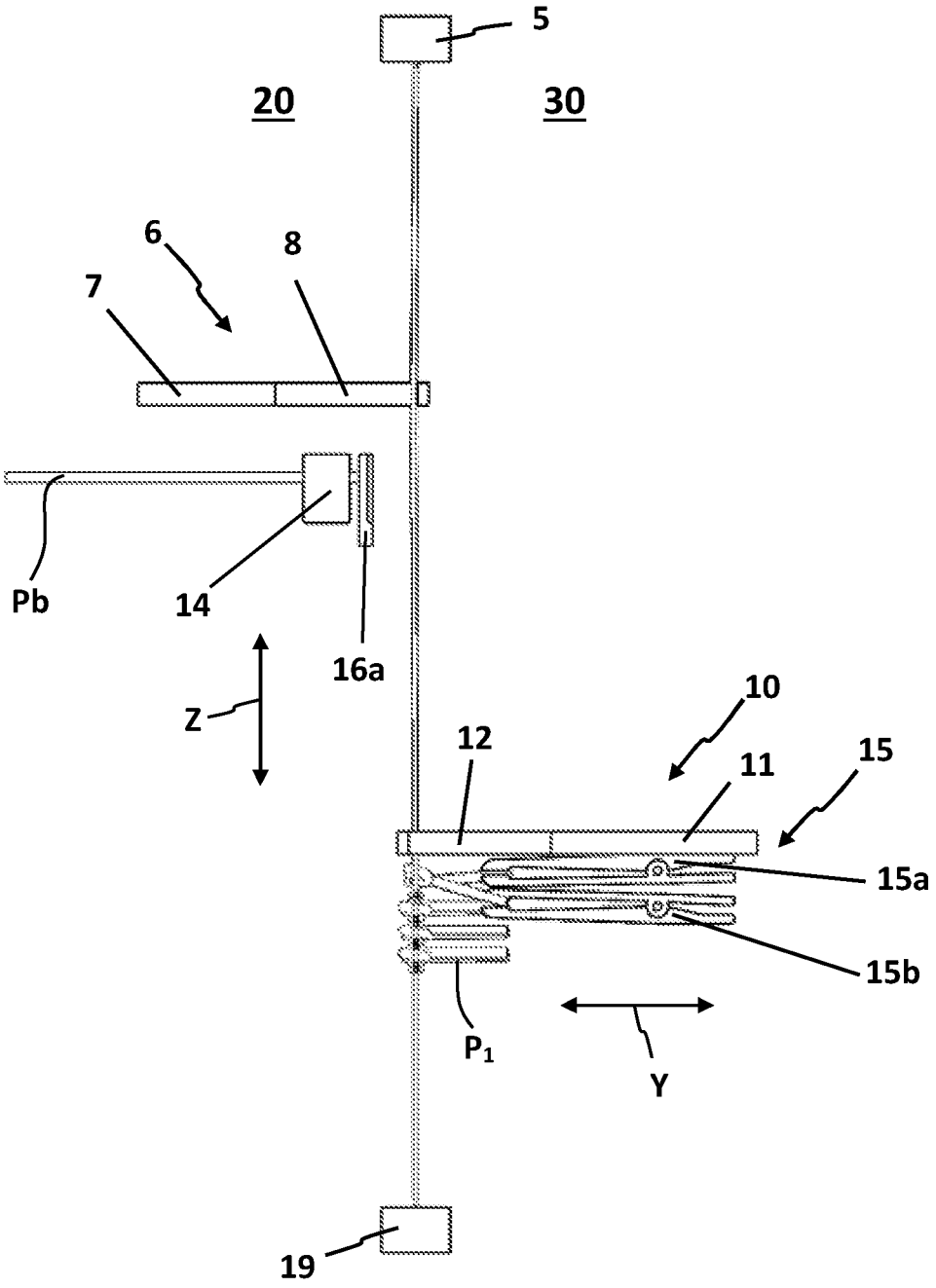
Figure 18:
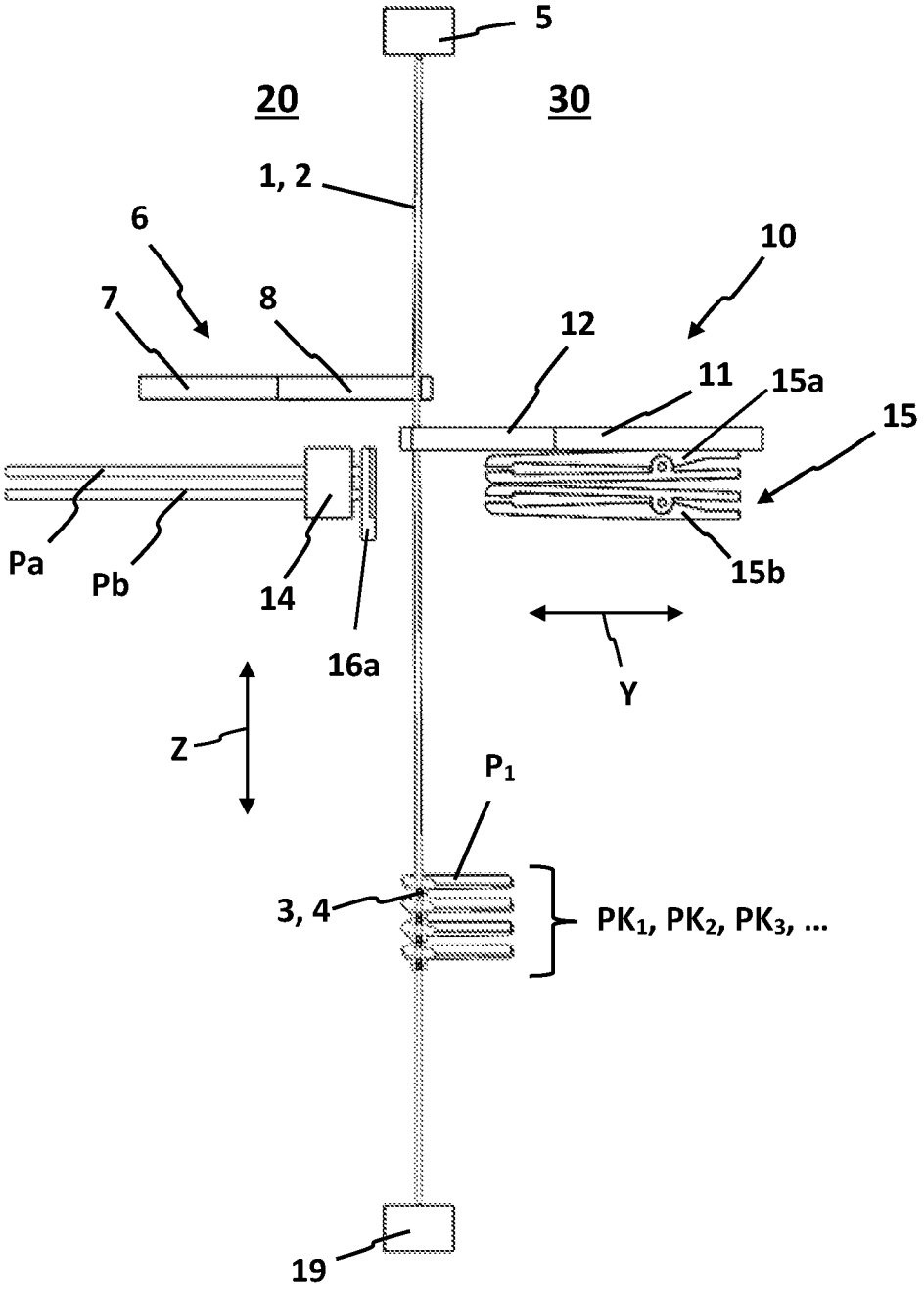
Figure 19:
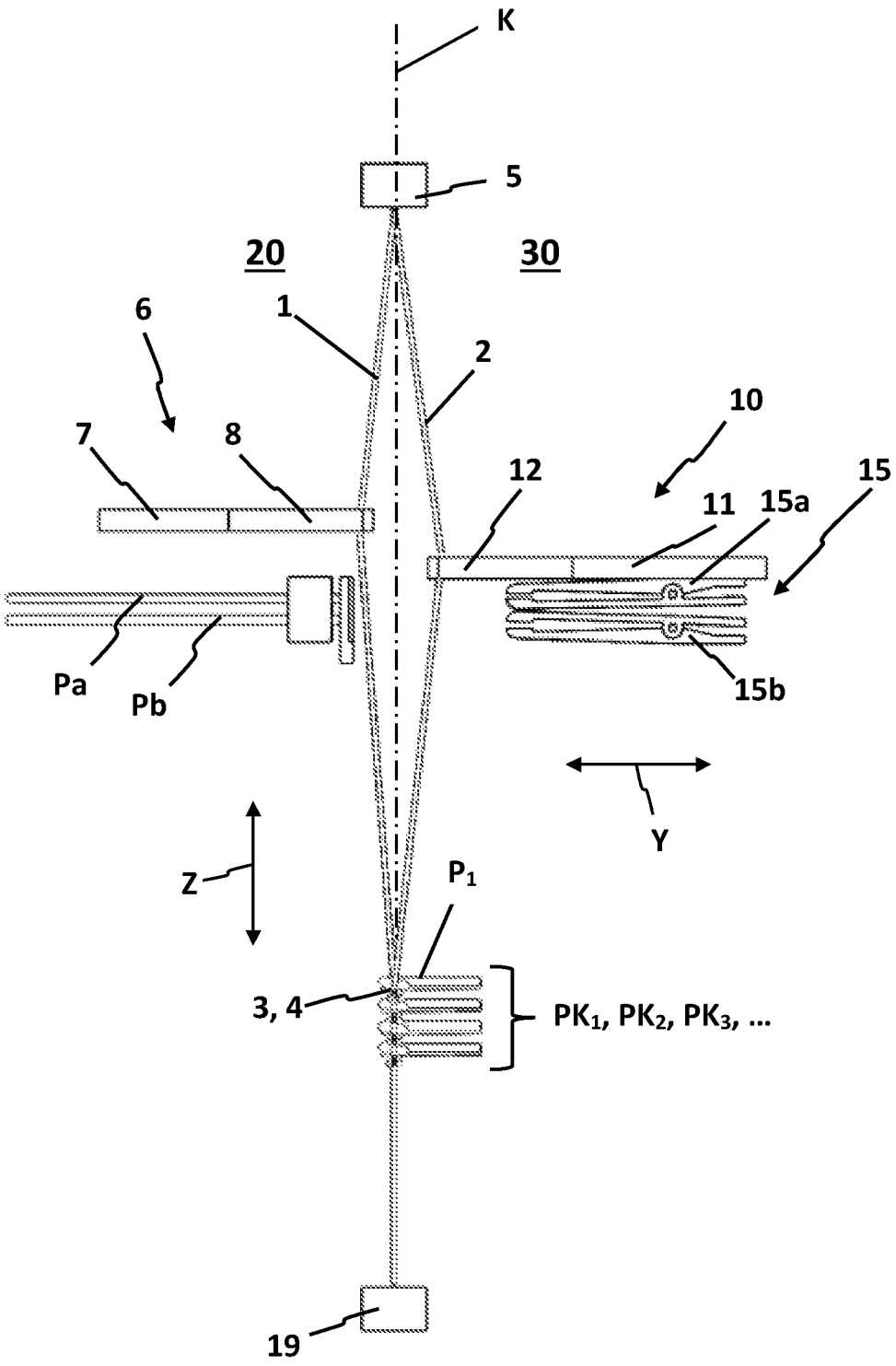
Figure 20:
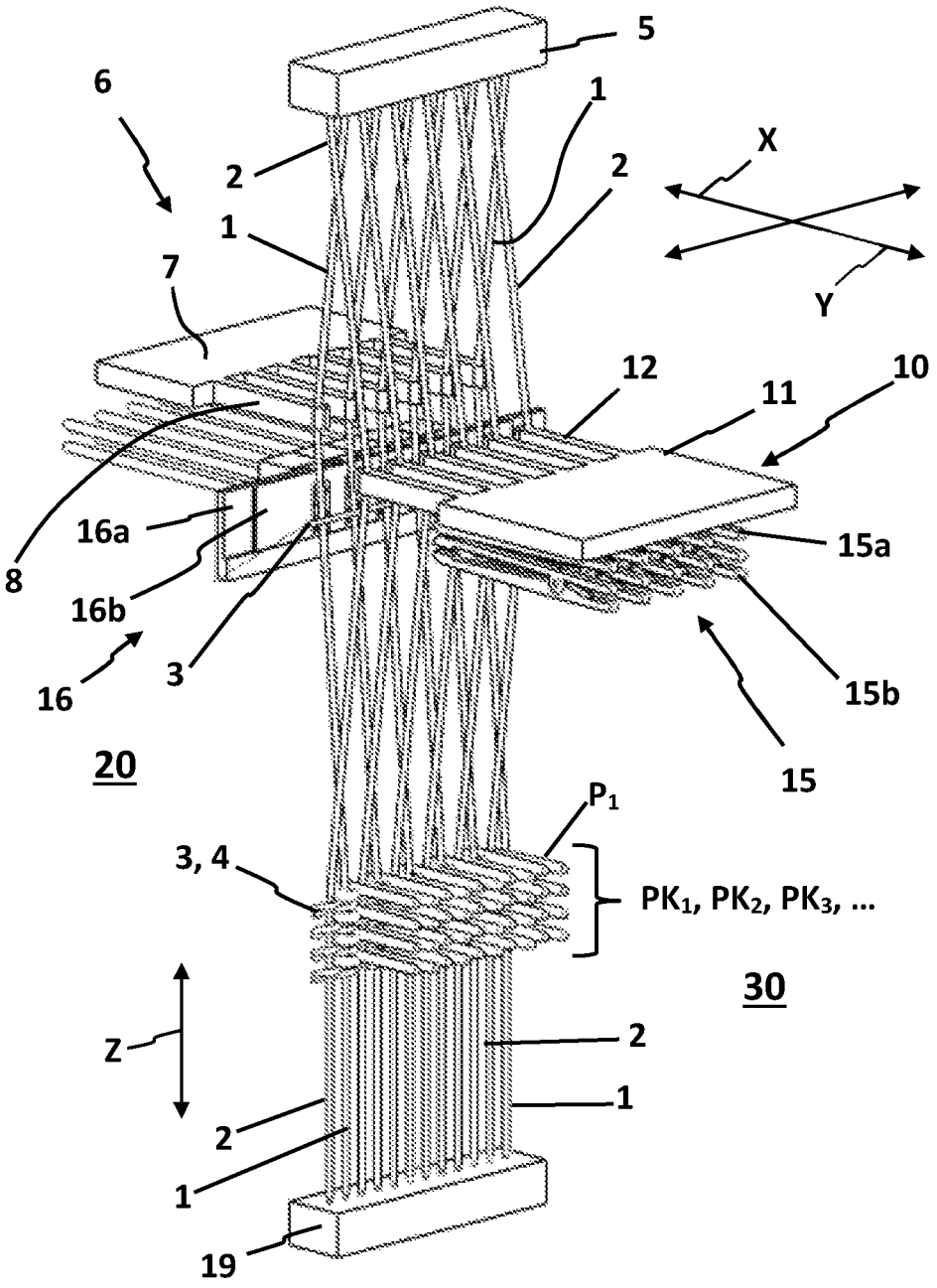
Figure 21:
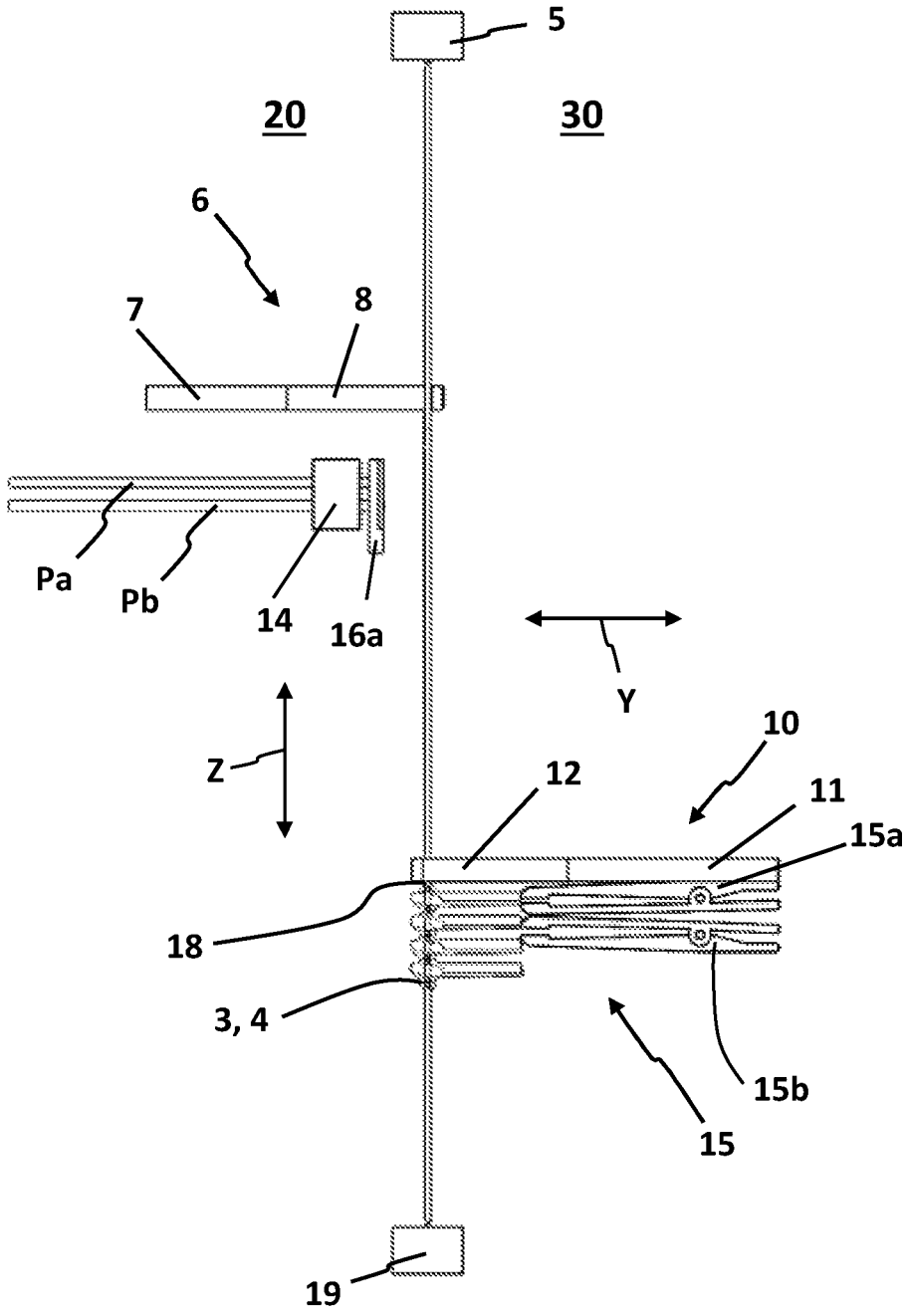
Figure 22:
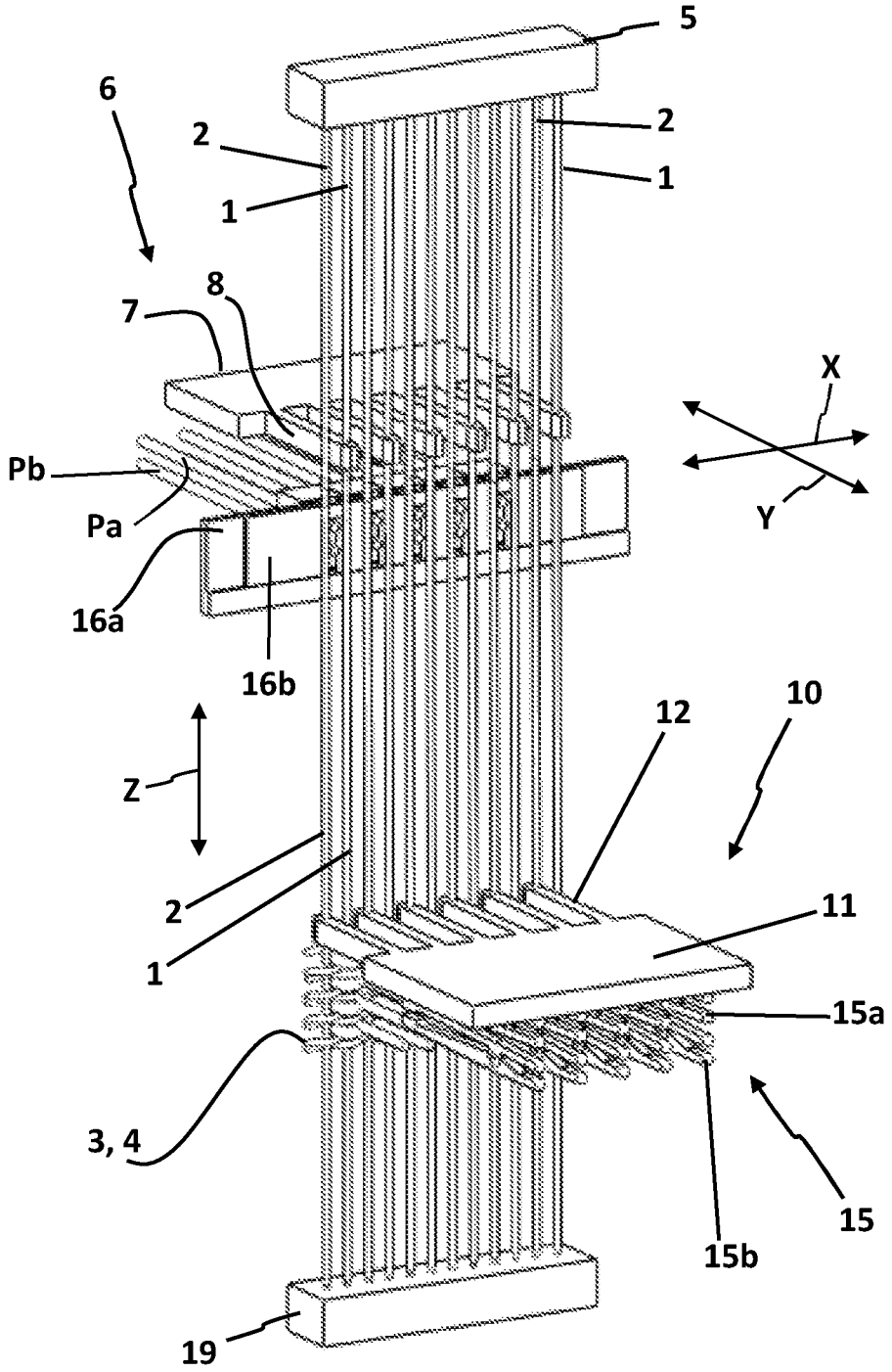
Figure 23:
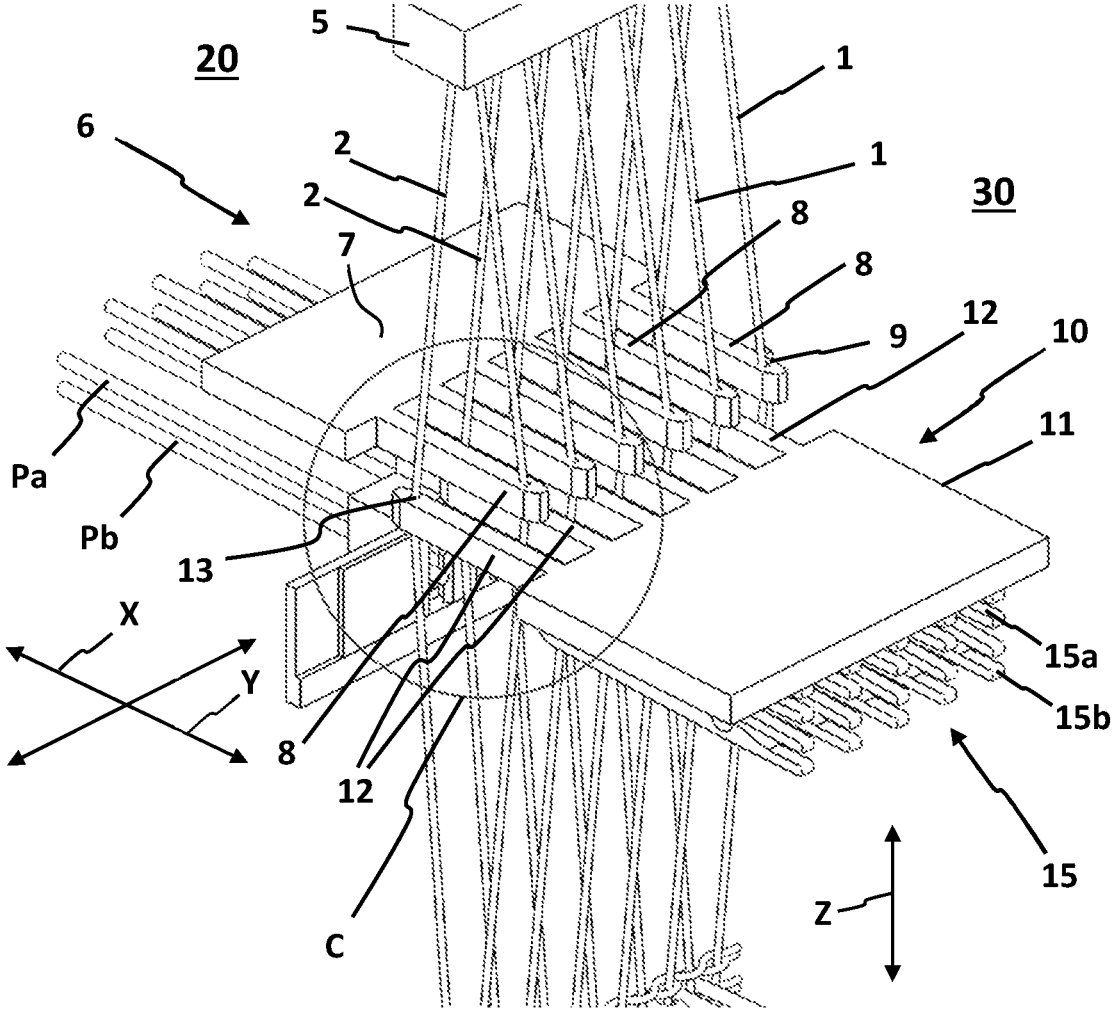
Figure 24:
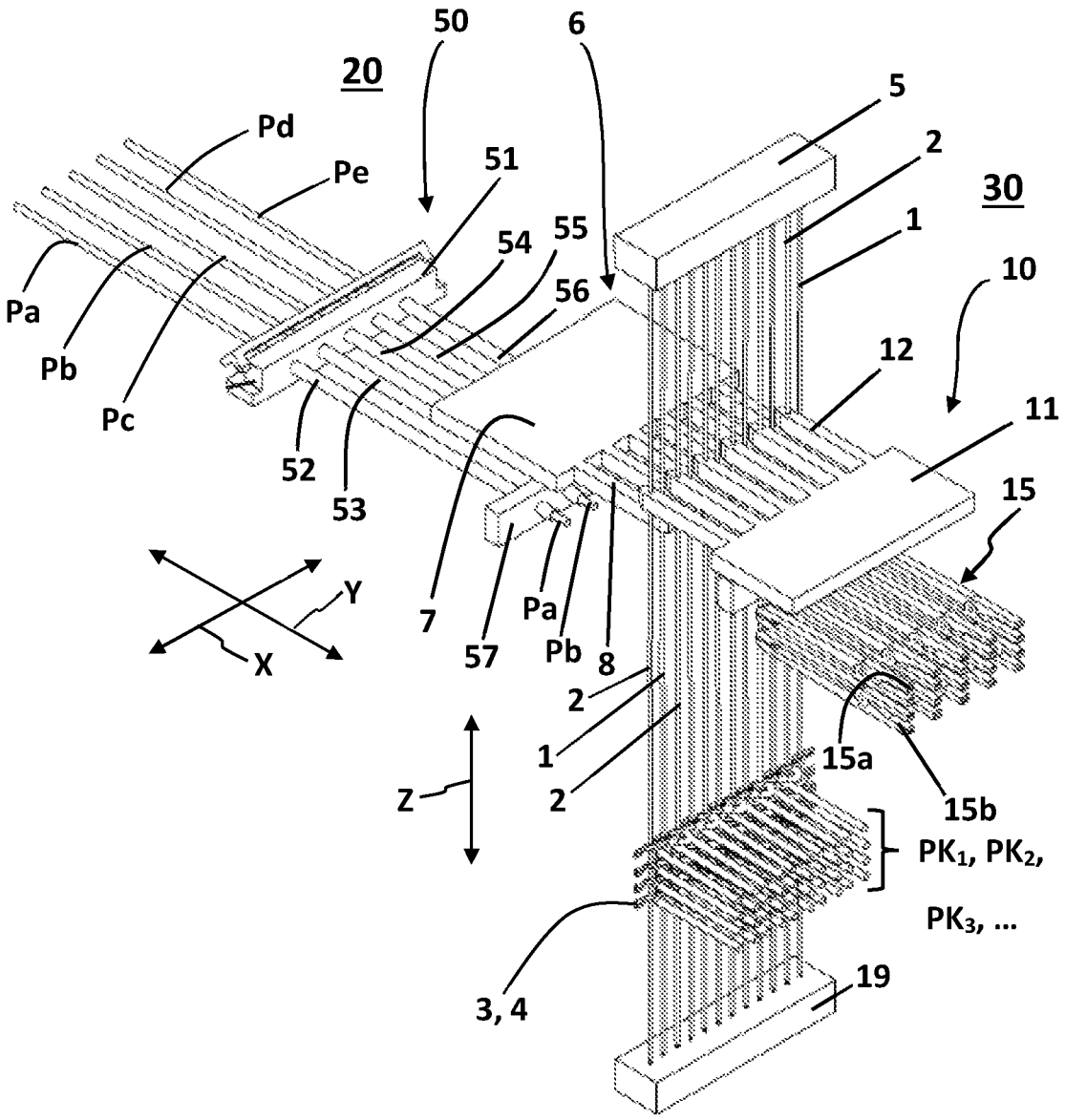
Figure 25:
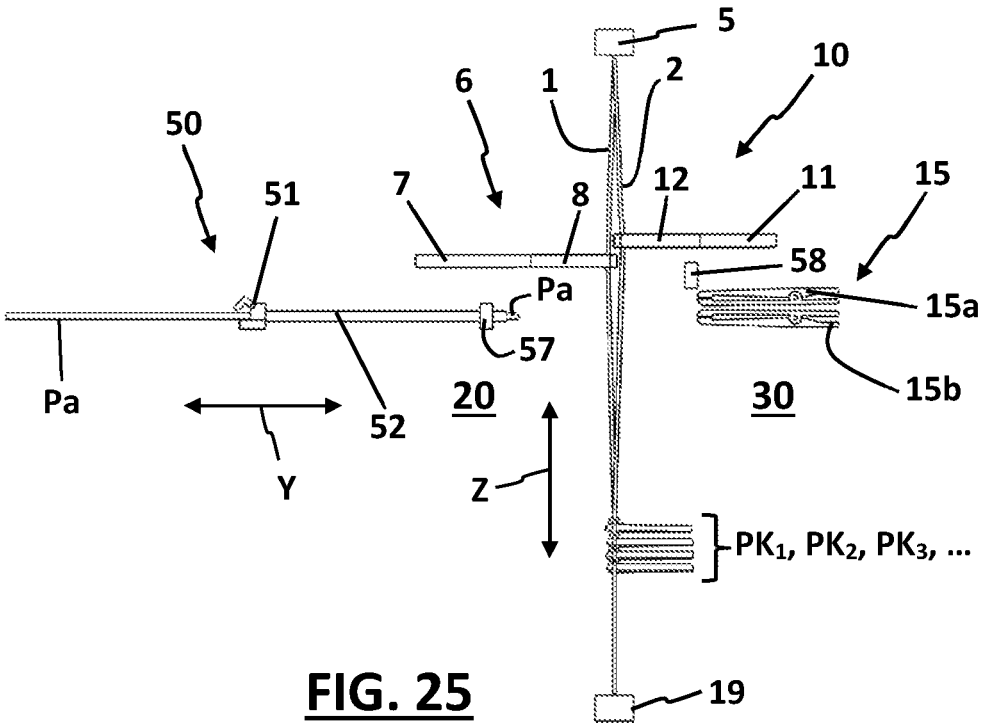
Figure 26:
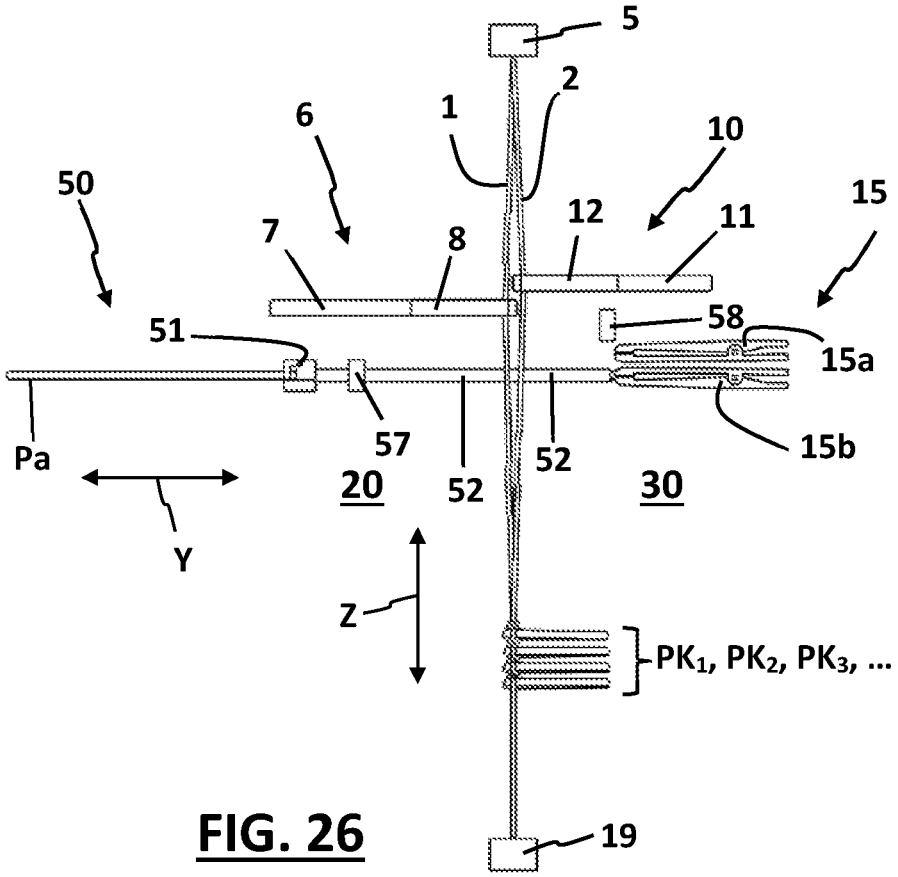
Figure 27:
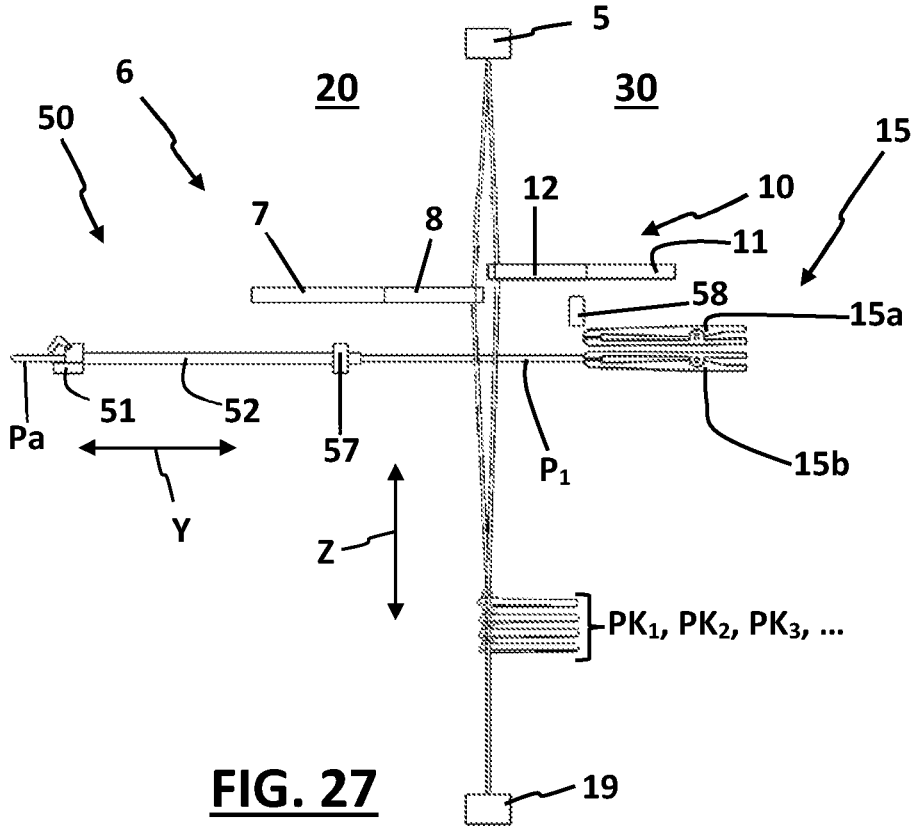
Figure 28:
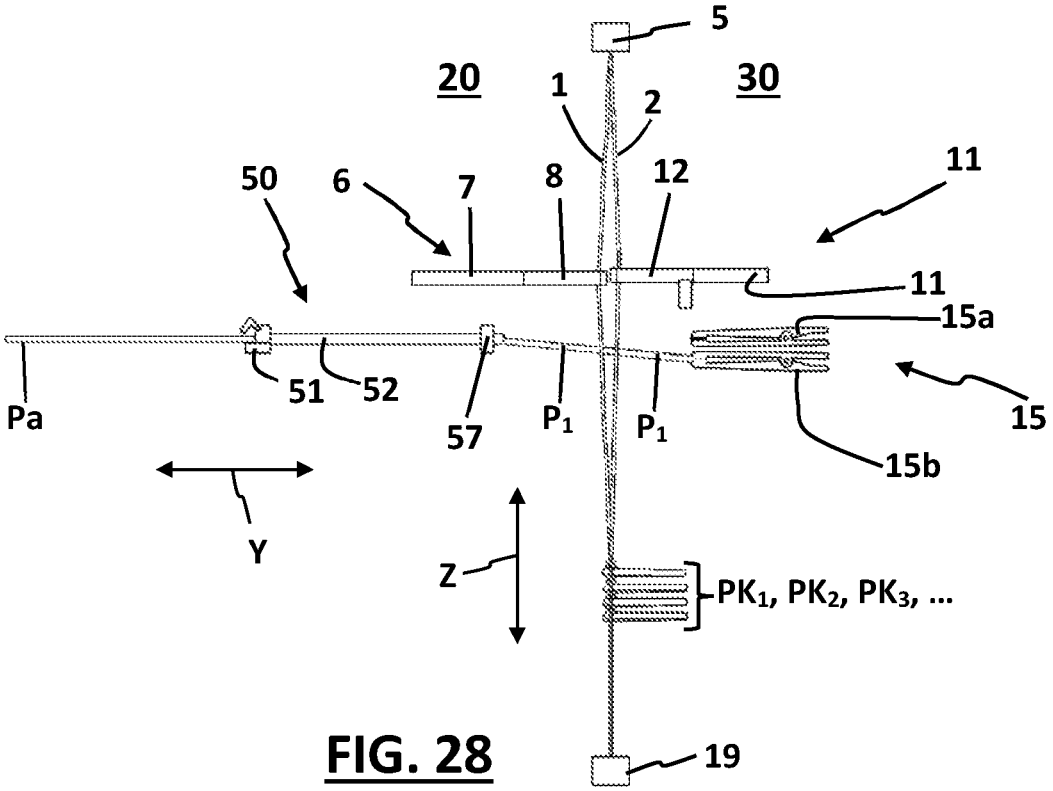
Figure 29:
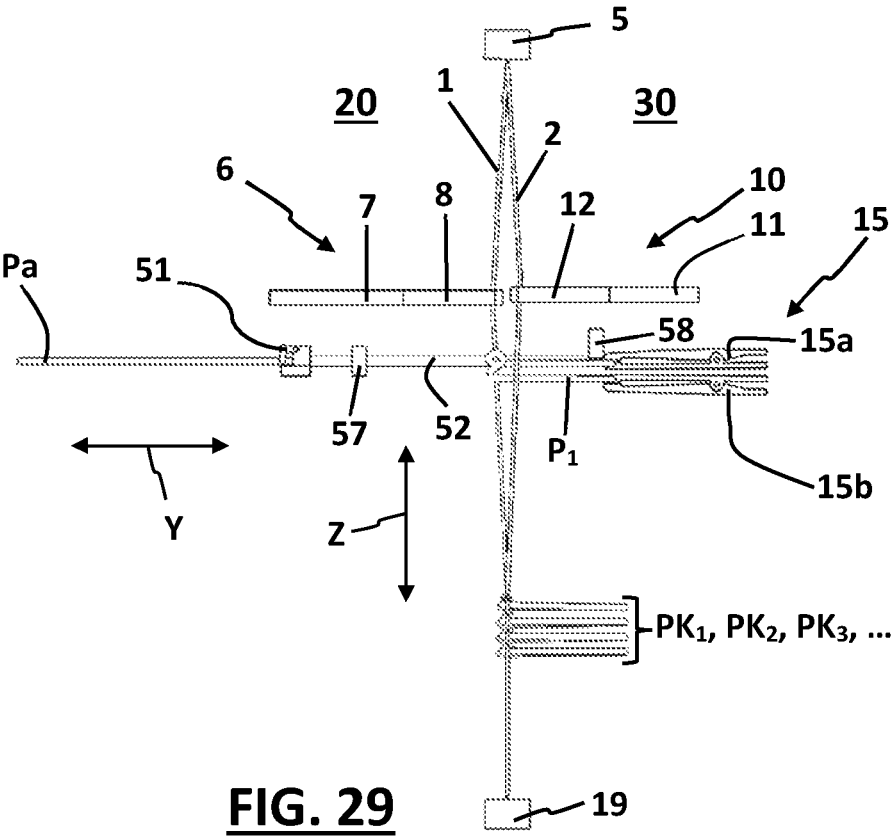
Figure 30:
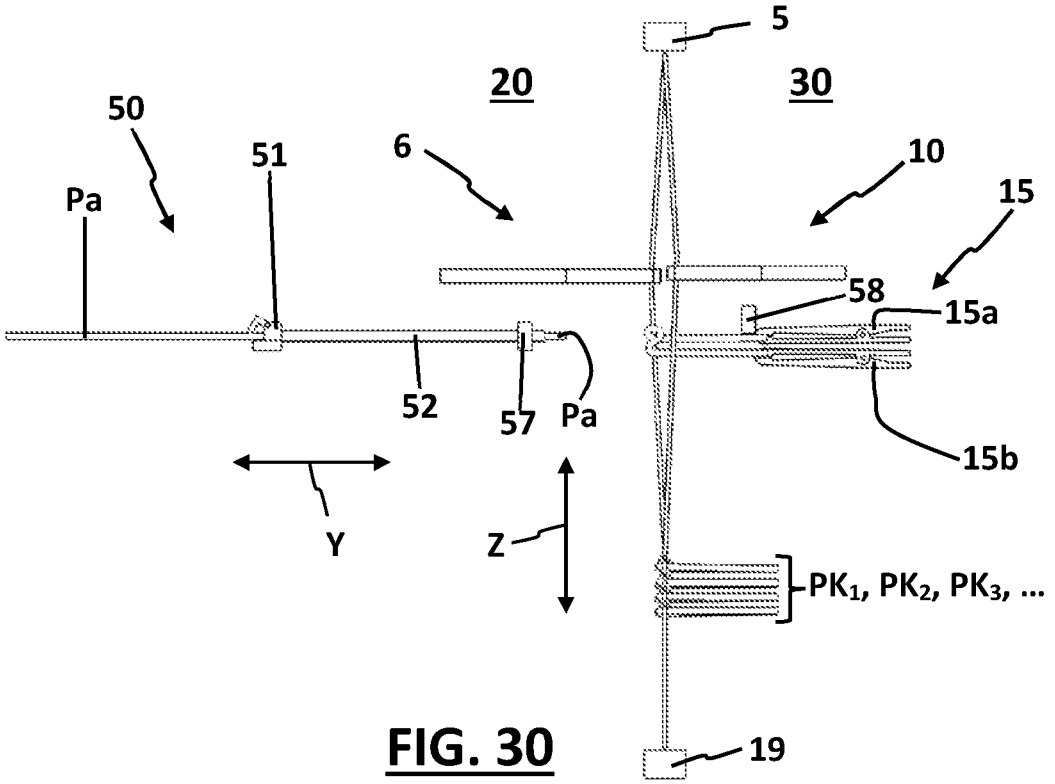

In this description, reference numbers are used for referring to the appended figures, where:

FIG. 1 is a schematic representation of a portion of a carpet with pile yarns which, through the formation of Persian knots that are open towards the left, are bound to warp yarns of a ground fabric;

FIG. 2 is a schematic representation of a portion of a carpet with pile yarns which, through the formation of Persian knots that are open towards the right, are bound to warp yarns of a ground fabric;

FIG. 3A illustrates, in a schematic cross-section of a pile fabric, how a pile yarn is bound to warp yarns of a ground fabric through the formation of a first variant of an asymmetric Jufti knot;

FIG. 3B illustrates, in a schematic cross-section of a pile fabric, how a pile yarn is bound to warp yarns of a ground fabric through the formation of a second variant of an asymmetric Jufti knot;

FIGS. 4A to 4H show schematically, in a number of successive steps, how Persian knots that are open towards the left are produced according to at least one embodiment of the present invention;

FIGS. 5A to 5H show schematically, in a number of successive steps, how Persian knots that are open towards the right are produced according to at least one embodiment of the present invention;

FIGS. 6 and 7 present a first embodiment of the weaving machine according at least one embodiment of to the invention, in a perspective view and in a side view, respectively;

FIGS. 8 to 24 present the weaving machine of FIGS. 6 and 7, at different time points during the carrying out of a weaving process according to at least one embodiment of the present invention, after carrying out fourteen successive steps respectively (step 1 to step 14 hereunder), wherein FIG. 8 shows the weaving machine in side view, after carrying out step 1, FIGS. 9 and 10 show the weaving machine, in a perspective view and in a front view respectively, after carrying out step 2, FIG. 11 shows the weaving machine in side view, after carrying out step 3, FIG. 12 shows the weaving machine in side view, after carrying out step 4, FIG. 13 shows the weaving machine in front view, after carrying out step 5, FIG. 14 shows the weaving machine in side view, after carrying out step 6, FIG. 15 shows the weaving machine in side view, after carrying out step 7, FIG. 16 shows the weaving machine in side view, after carrying out step 8, FIG. 17 shows the weaving machine in side view, after carrying out step 9, FIG. 18 shows the weaving machine in side view, after carrying out step 10, FIG. 19 shows the weaving machine in side view, after carrying out step 11, FIG. 20 shows the weaving machine in perspective, after carrying out step 12, FIGS. 21 and 22 show the weaving machine after carrying out step 13, in side view and in a perspective view respectively;

FIG. 23 shows the weaving machine in perspective, during the formation of a reversed shed;

FIG. 24 is a schematic representation of a second embodiment of the weaving machine according to at least one embodiment of the invention shown in perspective view; and FIGS. 25 to 30 show the weaving machine from FIG. 24 in side view at different time points during the carrying out of a weaving process according to at least one embodiment of the present invention, respectively after carrying out six successive steps (step 1 to step 6 hereinafter) during the formation of knots, wherein FIG. 25 shows the weaving machine after step 1, FIG. 26 shows the weaving machine after step 2, FIG. 27 shows the weaving machine after step 3, FIG. 28 shows the weaving machine after step 4, FIG. 29 shows the weaving machine after step 5, and FIG. 30 shows the weaving machine after step 6.

DETAILED DESCRIPTION

For weaving a Persian carpet (see FIGS. 1 to 3), warp yarns (1), (2) and weft yarns (3), (4) are woven together so that they form a ground fabric. For forming the pile (see FIGS. 1 and 2), pile yarns (P1), (P2), (P3) are bound via Persian knots ($PK_1$), ($PK_2$), ($PK_3$) to respective sequences of first (1) and second warp yarns (2) of the ground fabric. A large number of rows of Persian knots ($PK_1$), ($PK_2$), ($PK_3$) are formed, provided next to each other in the weft direction (X). The rows are close up against each other in the warp direction (Z), the direction in which the warp yarns extend in the carpet. The two end parts (L1*a*) (L1*b*); (L2*a*), (L2*b*); (L3*a*), (L3*b*) of each pile yarn (P1), (P2), (P3) project on the one side of the carpet, called the pile side (20). The other side is the back (30) of the carpet. If the carpet lies with the pile side (20) directed upwards on a more or less horizontal surface, the two end parts of each pile yarn (P1), (P2), (P3) project straight upwards or obliquely upwards and form vertical pile legs. In this description the term "carpet" is also used in the meaning of "the carpet in the process of formation".

In the formation of a Persian knot ($PK_1$), ($PK_2$), ($PK_3$) that is open towards the left (see FIG. 1), each pile yarn (P1), (P2), (P3) has, in relation to a first (1) and a second warp yarn (2), the following course: from the one end part (L1*a*), (L2*a*), (L3*a*) that projects on the pile side (20), the pile yarn (P1), (P2), (P3) runs between the first (1) and the second warp yarn (2) to the back (30) of the carpet and forms a closed loop round the first warp yarn (1) and then runs from the pile side (20) back between the first (1) and the second warp yarn (2) to the back (30) of the carpet, and is then wrapped round the second warp yarn (2) and finally runs on the side of the second warp yarn (2) directed away from the first warp yarn (1) back to the pile side (20) of the carpet, to finish with the second pile yarn end part (L1*b*), (L2*b*), (L3*b*) that projects on the pile side (20).

In the formation of a Persian knot ($PK_1$), ($PK_2$), ($PK_3$) that is open towards the right (see FIG. 2), the pile yarn (P1), (P2), (P3) runs from the one end part (L1*a*), (L2*a*), (L3*a*) that projects on the pile side (20), between the first (1) and the second warp yarn (2) to the back (30) of the carpet and forms a closed loop round the second warp yarn (2) and then runs from the pile side (20) back between the first (1) and the second warp yarn (2) to the back (30) of the carpet, and is then wrapped round the first warp yarn (1) and finally runs on the side of the first warp yarn (1) directed away from the second warp yarn (2) back to the pile side (20) of the carpet, to finish with the second pile yarn end part (L1*b*), (L2*b*), (L3*b*) that projects on the pile side (20).

A knotted pile yarn (P1), (P2), (P3) is, expressed in general language, in each case bound to the warp yarns of a sequence (I), (II), (III) of a first warp yarn system and a second warp yarn system. Since in the formation of a Persian knot ($PK_1$), ($PK_2$), ($PK_3$) as shown in FIGS. 1 and 2, each first warp yarn system only comprises one warp yarn (1) (called first warp yarn hereinafter) and each second warp yarn system also only comprises one warp yarn (2) (called second warp yarn hereinafter), it may be stated that, in a Persian knot, each pile yarn is bound to a sequence (I), (II), (III) of a first (1) and a second warp yarn (2). There are no other warp yarns between two sequences (I), (II), (III).

For forming a first variant ($JK_1$) of a so-called Jufti knot—see FIG. 3—the pile yarn (P4) is bound to four warp yarns, wherein the first warp yarn system and the second warp yarn system each comprise two warp yarns (1*a*), (1*b*); (2*a*), (2*b*). The course of the pile yarn (P4) for the first variant ($JK_1$) of this Jufti knot is similar to the course for a Persian knot ($PK_1$), ($PK_2$), ($PK_3$). However, two warp yarns (1*a*), (1*b*); (2*a*), (2*b*) are now provided per warp yarn system instead of one. The pile yarn (P4) runs from the one end part (L4*a*), which projects on the pile side (20), between the two warp yarn systems (1*a*, 1*b*); (2*a*,2*b*) to the back (30) of the carpet, forms a closed loop round the two warp yarns (2*a*), (2*b*) of the second warp yarn system and then runs from the pile side (20) between the two warp yarn systems (1*a*, 1*b*); (2*a*,2*b*) back again to the back (30) of the carpet, and finally runs on the side of the second warp yarn system (2*a*,2*b*) directed away from the first warp yarn system (1*a*, 1*b*) to the pile side (20) of the carpet, to finish with the second pile yarn end part (L4*b*) that projects on the pile side (20).

The course of the pile yarn (P4) in a second variant ($JK_2$) of this Jufti knot—see FIG. 4—is different in that the first and the second warp yarn systems contain one warp yarn (1) and three warp yarns (2*a*), (2*b*), (2*c*) respectively, and in that the pile yarn (P4) forms a loop round only two (2*b*), (2*c*) of the three warp yarns (2*a*), (2*b*), (2*c*) of the second warp yarn system, where the loop for the other knots in FIGS. 1, 2 and 3A is in each case formed round "all" warp yarns (1), (2), (2a,2b) of a warp yarn system.

To weave a carpet whose pile yarns are bound via Persian knots ($PK_1$), ($PK_2$), ($PK_3$) to the warp yarns of the ground fabric, preferably the work proceeds following the principle whose most important successive steps are presented in FIGS. 4A-4H and 5A-5H.

A row of warp yarns (1), (2) is provided, consisting of successive sequences (I), (II), (III) of first and second warp yarns (1), (2). The row of warp yarns thus contains alternately a first (1) and a second warp yarn (2). The starting point is warp yarns that run next to each other approximately in one and the same plane, called a warp yarn plane (K) hereinafter. This initial situation is presented in FIGS. 4A and 5A. The order of the first (1) and second warp yarns (2), seen in the weft direction (X), is important. If, in FIGS. 4A and 5A, looking for example from the left-hand side of the warp yarns (1), (2) in the weft direction (X), it can be seen that, in each sequence (I), (II), (III) of a first (1) and a second warp yarn (2), the first warp yarn (1) is provided first, and then the second warp yarn (2). This order is called "the original order" hereinafter.

Between the first (1) and the second warp yarn (2) of each sequence (I), (II), (III) there is a passage in a transverse direction (Y), which is approximately perpendicular to the warp yarn plane (K). When the warp yarns (1), (2) of the sequences (I), (II), (III) are in the original order, this passage is called the first gap (T1).

Figure 4A:
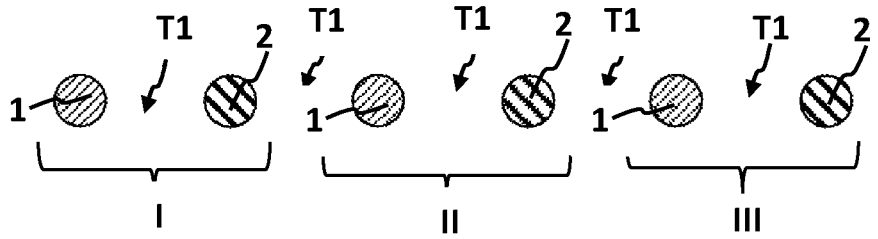
Figure 4B:
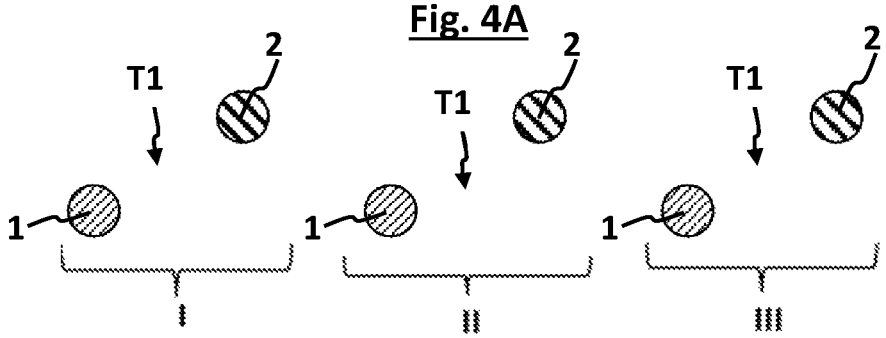

In a first step, the first (1) and the second warp yarns (2) are moved some distance apart in a transverse direction (Y), which is perpendicular to the warp yarn plane (K). The result of this first step is shown in FIGS. 4B and 5B. The first warp yarns (1) then run over at least part of their length in a first warp yarn plane (K1), while the second warp yarns (2) run, over at least part of their length, in a second warp yarn plane (K2). In FIG. 4B the first warp yarn plane (K1) is located under the second warp yarn plane (K2). In FIG. 5B this is reversed: the first warp yarn plane (K1) is located above the second warp yarn plane (K2). As a result, according to the method in FIGS. 4A-4G, a Persian knot ($PK_1$), ($PK_2$), ($PK_3$) is formed that is open towards the left, and according to the method in FIGS. 5A-5G, a Persian knot ($PK_1$), ($PK_2$), ($PK_3$) is formed that is open towards the right.

In a second step, the second warp yarns (2) are moved towards the left in the weft direction (X) and the first warp yarns (1) are moved towards the right in the weft direction (X), over a distance such that the order of the warp yarns (1), (2) of the various sequences (I), (II), (III), seen in the weft direction (X), is reversed. The result of this second step is presented in FIG. 4C and FIG. 5C. Seen from the left-hand side in the weft direction (X), the second warp yarn (2) in each sequence (I), (II), (III) is now in front of the first warp yarn (1).

Between the first (1) and the second warp yarn (2) of each sequence (I), (II), (III) there is a passage in said transverse direction (Y). Now the warp yarns (1), (2) of the sequences (I), (II), (III) are in the reversed order; this passage is called the second gap (T2).

In the formation of a Persian knot ($PK_1$), ($PK_2$), ($PK_3$) that is open towards the left (FIG. 4C), the second warp yarns (2) are moved over a greater distance than the first warp yarns (1), so that the first warp yarn (1) of the first (I) and of the second sequence (II) is located under the second warp yarn (2) of the second (II) and of the third sequence (III), respectively.

In the formation of a Persian knot ($PK_1$), ($PK_2$), ($PK_3$) that is open towards the right (FIG. 5C), the first warp yarns (1) are moved over a greater distance than the second warp yarns (2), so that the first warp yarn (1) of the first (I) and of the second sequence (II) is located above the second warp yarn (2) of the second (II) and of the third sequence (III), respectively.

Between the first (1) and the second warp yarn (2) of each sequence (I), (II), (III) there is a passage in said transverse direction (Y). Now the warp yarns (1), (2) of the sequences (I), (II), (III) are in the reversed order; this passage is called the second gap (T2). Because the first (1) and the second warp yarns (2) are moved over a different distance, wherein the larger distance is about double the smaller distance, the second gap (T2) between the first (1) and second warp yarn (2) of each sequence is wide. This second gap (T2) is located opposite a respective pile yarn feeder (14).

Figure 4D:
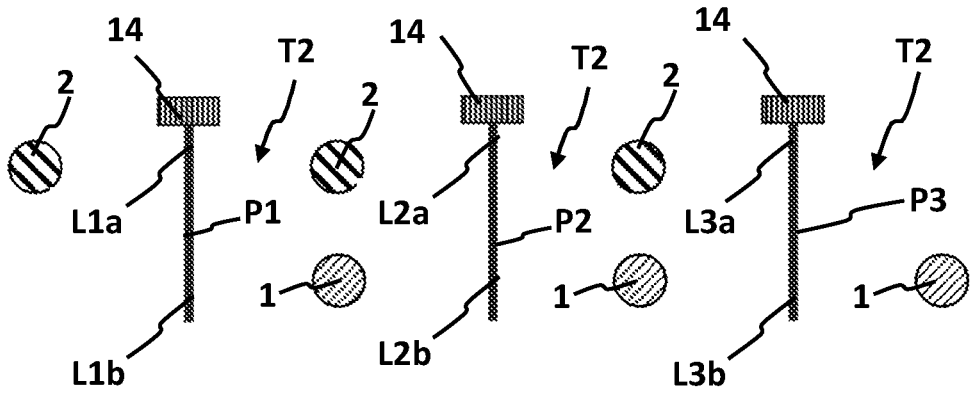
Figure 5A:
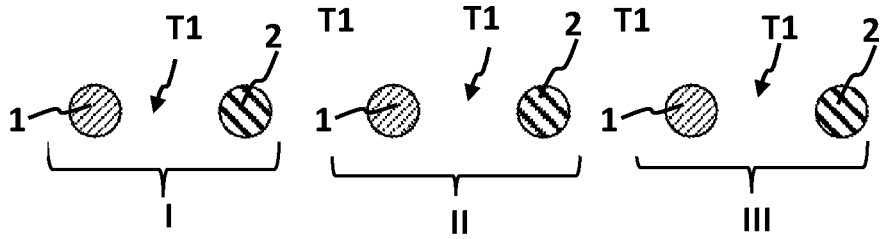
Figure 5B:
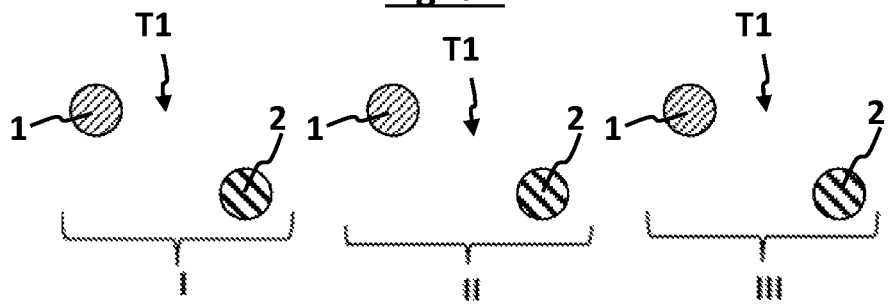

In a third step, a respective pile yarn (P1), (P2), (P3) is inserted in each second gap (T2), so that the first end part (L1a), (L2a), (L3a) of this pile yarn is located on the one edge (20) of the warp yarns (1), (2), still joined to a pile yarn supply (not shown in the figures) and its second end part (L1b), (L2b), (L3b) projects on the other edge (30) of the warp yarns (1), (2). The result of this third step is shown in FIGS. 4D and 5D.

In a fourth step, the second warp yarns (2) are moved towards the right in the weft direction (X) and the first warp yarns (1) are moved towards the left over the same distance in the weft direction (X), so that the warp yarns (1), (2) of the various sequences (I), (II), (III), seen in the weft direction (X), are back in the original order. The result of this fourth step is shown in FIGS. 4E and 5E. Seen in the weft direction (X) from the left-hand side of the warp yarns (1), (2), the first warp yarn (1) in each sequence (I), (II), (III) is again in front of the second warp yarn (2). In each sequence (I), (II), (III), between the first (1) and the second warp yarn (2), a passage is formed in the transverse direction (Y), which is called "the third gap (T3)".

Owing to this displacement of the first (1) and the second warp yarns (2) in the fourth step, the course of the pile yarns (P1), (P2), (P3) is also changed. In FIG. 4E, each pile yarn (P1), (P2), (P3) runs from its first end part (L1a), (L2a), (L3a), which is located on the one edge (20) of the warp yarns (1), (2) and is still held in the pile yarn feeder (14), first to the right-hand side from the second warp yarn (2) on the other edge (30), is then turned towards the left and runs successively on the other edge (30) past the second warp yarn (2) and on the one edge (20) past the first warp yarn (1), and finally runs on the left-hand side of the first warp yarn (1) on the other edge (30) of the warp yarns, ending there with its second end part (L1b), (L2b), (L3b), which projects on the other edge (30).

In FIG. 5E, each pile yarn (P1), (P2), (P3) runs from its first end part (L1a), (L2a), (L3a), which is located on the one edge (20) of the warp yarns (1), (2) and is still held in the pile yarn feeder (14), first to the left-hand side of the first warp yarn (1) on the other edge (30), then is turned to the right and runs successively on the other edge (30) past the first warp yarn (1) and on the one edge (20) past the second warp yarn (2), and finally runs on the right-hand side of the second warp yarn (2) on the other edge (30) of the warp yarns, ending there with its second end part (L1b), (L2b), (L3b), (L4a), which projects on the other edge (30) of the warp yarns (1), (2).

In a fifth step, in each sequence (I), (II), (III) the pile yarn (P1), (P2), (P3) is cut away from the pile yarn supply (not shown) and released from the pile yarn feeder (14), and the first end part (L1a), (L2a), (L3a) of the pile yarn located on the one edge (20) is pulled through the third gap (T3)

between the first and the second warp yarn (2) so that this end part (L1*a*), (L2*a*), (L3*a*) extends via this third gap (T3) up to the other edge (30) of the warp yarns (1), (2) and projects on this other edge (30). The result of this fifth step is shown in FIGS. 4F and 5F. Each pile yarn now forms a closed loop round the second warp yarn (2)—in FIG. 4F—or round the first warp yarn (1)—in FIG. 5F—of the respective sequence and both end parts (L1*a*), (L1*b*); (L2*a*), (L2*b*); (L3*a*), (L3*b*) of each pile yarn (P1), (P2), (P3) now project on the other edge (30) of the warp yarns.

In a sixth step, in the formation of a Persian knot that is open towards the left (FIG. 4G), the first warp yarns (1) are moved towards the right, and in the formation of a Persian knot that is open towards the right (FIG. 5G), the second warp yarns (2) are moved towards the left, so that the unequal movement of the first (1) and of the second warp yarns (2)—in the second step—is neutralized and the successive warp yarns (1), (2) of the row are moved apart again with the original clearances in the weft direction (X).

In a seventh step, the first (1) and the second warp yarns (2) are moved in the transverse direction (Y) until they are back in the same warp yarn plane (K). The result of this seventh step is shown in FIGS. 4H and 5H. The pile yarns (P1), (P2), (P3) form Persian knots ($PK_1$), ($PK_2$), ($PK_3$) with pile legs that project on the underside (in each case called the other edge (30) in the foregoing). This is the pile side (30) of the carpet. The upper side (in each case called the one edge (20) in the foregoing) is the back (20) of the carpet.

In the method according to FIGS. 4A-4G, Persian knots ($PK_1$), ($PK_2$), ($PK_3$) are obtained that are open towards the left, as is also shown in FIG. 1. In the method according to FIGS. 5A-5G, Persian knots ($PK_1$), ($PK_2$), ($PK_3$) are obtained that are open towards the right, as is also shown in FIG. 2.

This working method can be automated by using a weaving machine with the components, features and operation indicated hereunder. For clarity, the weaving machine in the figures (starting from FIG. 6) of this patent application has been presented as a weaving machine that is configured for weaving with a very limited number of warp yarns. In practice, of course, many more warp yarns are needed in order to weave a carpet. When examining these drawings it is consequently necessary to take into account that the dimensions and shapes and numbers of certain components of the weaving machine will in most cases have to be adapted to this larger number of warp yarns.

In this weaving machine, a beam installation (5) is provided, from which a row of warp yarns (1), (2) running next to each other with equal spacing can be unwound, as the weaving process proceeds. A first (1) and a second warp yarn (2) are provided alternately, following the principle presented in FIGS. 4A and 5A.

The weaving machine has two movable positioning bodies (6), (10) with which the path of the first (1) and of the second warp yarns (2) can be changed, as will be explained further. These positioning bodies (6), (10) are placed in FIGS. 6 and 7 in such a way that the first (1) and the second warp yarns (2) extend next to each other in the same warp yarn plane (K). The positioning bodies (6), (10) are on the one hand configured to form a shed in each case in successive weft insertion cycles, between these first (1) and second warp yarns (2), so that in each case a weft yarn (3) can be inserted in this shed in the indicated weft direction (X). For this purpose the weaving machine is provided with a weft insertion mechanism (not shown in the figures). The positioning bodies (6), (10) are on the other hand also configured to position the warp yarns in successive pile forming cycles.

The first positioning body (6) is provided on the one edge (20) of the warp yarn plane (K) and is movable in a transverse direction (Y) that is approximately transverse to the warp yarn plane (K). The first positioning body (6) has a base portion (7) with an upper surface (7*a*) and a lower surface (7*b*). A number of fingers (8) abut against the base portion (7), which are directed from the base portion (7) to the warp yarns (1), (2) in the transverse direction (Y) and which are provided parallel next to each other with equal spacing. A warp yarn passage (9) is provided in each finger (8). A respective first warp yarn (1) extends through each warp yarn passage (9).

The second positioning body (10) is provided on the other edge (30) of the warp yarn plane (K) opposite the first positioning body (6) and is movable in the transverse direction (Y) and in the direction (Z) in which the warp yarns extend in the warp yarn plane (K). Each second positioning body (10) also has a base portion (11) with an upper surface (11*a*) and a lower surface (11*b*), on which a number of fingers (12) abut, which are directed from the base portion (11) to the warp yarns (1), (2) in the transverse direction (Y) and which are provided parallel next to each other with equal spacing. A warp yarn passage (13) is also provided in each finger (12). A respective second warp yarn (2) extends through each warp yarn passage (13).

On the one edge (20) of the warp yarn plane (K), under the first positioning body (6), a number of pile yarn feeders (14) are provided in a row that extends in the weft direction (X). On the other edge (30) of the warp yarn plane (K), a number of pile yarn receivers (15) are provided in a row that extends in the weft direction (X). Each pile yarn feeder (14) is configured to interact with a respective pile yarn receiver (15). There are as many pile yarn feeders (14) and associated pile yarn receivers (15) as there are pile yarns that must be knotted to the warp yarns (1), (2) in one pile forming cycle. In each pile forming cycle, a respective pile yarn (P1), (P2), (P3) must be knotted to each set of a first (1) and a second warp yarn (2).

Each pile yarn feeder (14) comprises two holders, provided with a gap between them, for holding a respective pile yarn of a set of two pile yarns (Pa), (Pb) with a different colour. Each pile yarn feeder (14) is movable in the direction (Z) in which the warp yarns (1), (2) extend and may be placed in two different positions. In the one position, a pile yarn (P1), which is the end part of the one pile yarn (Pa), is held in a feed position opposite the associated pile yarn receiver (15). In the other position, a pile yarn (P2), which is the end part of the other pile yarn (Pb), is held in a feed position opposite the associated pile yarn receiver (15).

Therefore each pile yarn feeder (14) can, in each pile forming cycle, selectively position one of two different pile yarns (P1), (P2) in a feed position opposite the associated pile yarn receiver (15) in order to bring in each case a pile yarn with the desired colour into the pull-through position, to cut it off and form a knot ($PK_1$), ($PK_2$), ($PK_3$) with it. The colours are for example selected to form a predetermined design or pattern in the pile of the carpet.

The holders of the pile yarn feeder (14) are configured to hold the selected pile yarn (P1) with a yarn end in a feed position so that the pile yarn receiver (15) can grip this yarn end. The pile yarns are at that moment still joined to a respective pile yarn supply that is wound on a bobbin (not shown in the figures).

On the other edge (30) of the warp yarn plane (K), a number of pile yarn receivers (15) are provided in a row that extends in the weft direction (X). These pile yarn receivers (15) are fastened to the lower surface (11*b*) of the base portion (11) of the second positioning body (10) and so are movable together with the second positioning body (10) in the direction (Z) in which the warp yarns extend in the warp yarn plane (K). Each pile yarn receiver (15) comprises an upper rapier (15*a*) and a lower rapier (15*b*), which are fastened together. Each rapier (15*a*), (15*b*) has an open and a closed state and can be placed via drivers (not shown) in the open or the closed state in order to grip an end part of a pile yarn or release it again. Each rapier (15*a*), (15*b*) is also movable separately in the transverse direction (Y). The lower rapier (15*b*) is configured to grip the first end portion (L1*a*) of a pile yarn (P1), (P2), (P3) that has been selected and placed in a feed position and bring it into the pull-through position, and the upper rapier (15*a*) is configured to grip the second end portion (L1*b*) of the pile yarn (P1), (P2), (P3) in a later phase of knot formation and pull it through between the first (1) and the second warp yarn (2) to the other edge (30) of the warp yarns. This is explained further in this description.

Between the first positioning body (6) and the warp yarn plane (K), a cutting device (16) is provided, consisting of an elongated fixed portion (16*a*) with a longitudinal axis (W) that extends in the weft direction (X) and a slidable cutting portion (16*b*) that is slidable along the longitudinal axis (W) relative to the fixed portion (16*a*).

An opening for each pile yarn (P1) is provided in the fixed portion (16*a*) and the cutting portion (16*b*) of the cutting device (16). The openings in the fixed portion (16*a*) and the openings in the cutting portion (16*b*) overlap each other in a certain position of the cutting portion (16*a*) so that they form passages (17) (these passages (17) are only indicated in FIG. 6) and so that each pile yarn (P1), (P2), (P3) that is in the aforementioned feed position is located with the first end portion (L1*a*), (L2*a*), (L3*a*) opposite or in a respective passage (17). The openings in the cutting portion (16*b*) and/or the openings in the fixed portion (16*a*) have vertical cutting edges. The cutting portion (16*b*) can be moved along the longitudinal axis (W) to another position where the openings in the fixed portion (16*a*) and the openings in the cutting portion (16*b*) no longer overlap each other. During this sliding motion, the pile yarns (P1), (P2), (P3) that extend through a respective passage (17) are cut through.

In the bottom portion of FIGS. 6 and 7, three rows of Persian knots ($PK_1$), ($PK_2$), ($PK_3$) are shown, which extend in the weft direction (X) and are joined to the warp yarns (1), (2). Between two rows of knots ($PK_1$), ($PK_2$), ($PK_3$), in each case two weft yarns (3), (4) are inserted in the weft direction (X). These weft yarns (3), (4) run, in opposition of phase, alternately on the one edge (20) and on the other edge (30) of the successive warp yarns (1), (2), as is also shown in FIGS. 1 and 2. Thus, the warp yarns (1), (2) of the row and the weft yarns (3), (4) become a ground fabric with, alternately in the warp direction (Z), two weft yarns (3), (4) interwoven with the warp yarns and a row of Persian knots ($PK_1$), ($PK_2$), ($PK_3$). The carpet thus formed is wound automatically on a carpet winding mechanism (19).

FIGS. 8 to 23 now show 14 different successive states of this weaving machine, in each case after execution of a successive step of the weaving process.

In a first step, the first positioning body (6) and the second positioning body (10) are moved away from each other in opposite directions in the transverse direction (Y) so that the first (1) and the second warp yarns (2) are some distance apart in the transverse direction (Y). This follows the principle that was also shown in FIGS. 4B and 5B. The state of the weaving machine after carrying out this step 1 is shown in FIG. 8. Seen in a plane that is perpendicular to the warp yarn plane (K)—the plane in FIG. 8—the paths of the warp yarns (1), (2) are altered between the beam installation (5) and the edge (18) of the fabric in the process of formation (called the fabric edge (18) hereinafter). On the one edge (20) of the warp yarn plane (K), the first warp yarns (1) are pulled outside of the warp yarn plane (K) by the first positioning body (6) and now follow an altered path wherein, from the beam installation (5) to the first positioning body, they are first moved obliquely from the warp yarn plane (K) and then, from the first positioning body (6) to the fabric edge (18), they again run obliquely to the warp yarn plane (K). On the other edge (30) of the warp yarn plane (K), the second warp yarns (2) are pulled outside of the warp yarn plane (K) by the second positioning body (6) and now follow an altered path wherein, from the beam installation (5) to the second positioning body (10), they are also first moved obliquely from the warp yarn plane (K) and then from the second positioning body (6) to the fabric edge (18) they again run obliquely to the warp yarn plane (K). The altered paths of the first and the second warp yarns are more or less symmetric relative to the warp yarn plane (K).

Figure 4C:
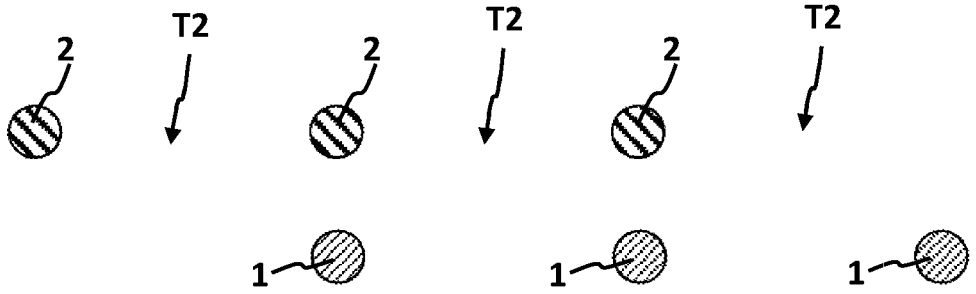
Figure 4E:
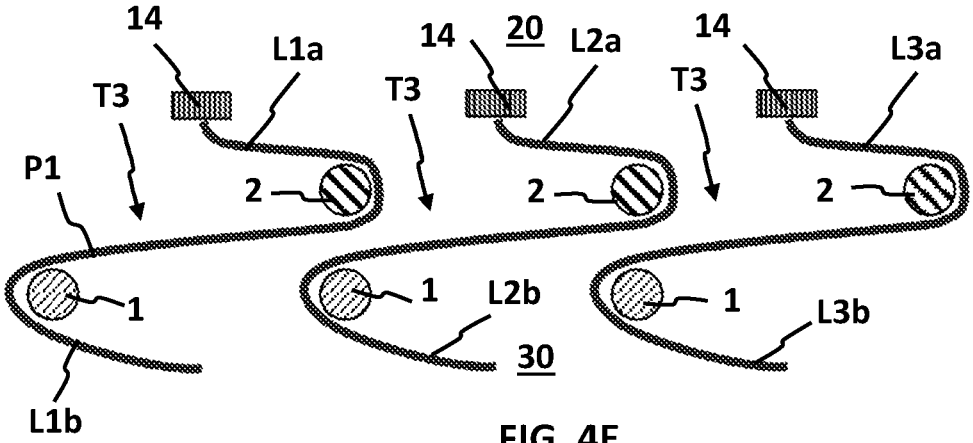
Figure 4F:
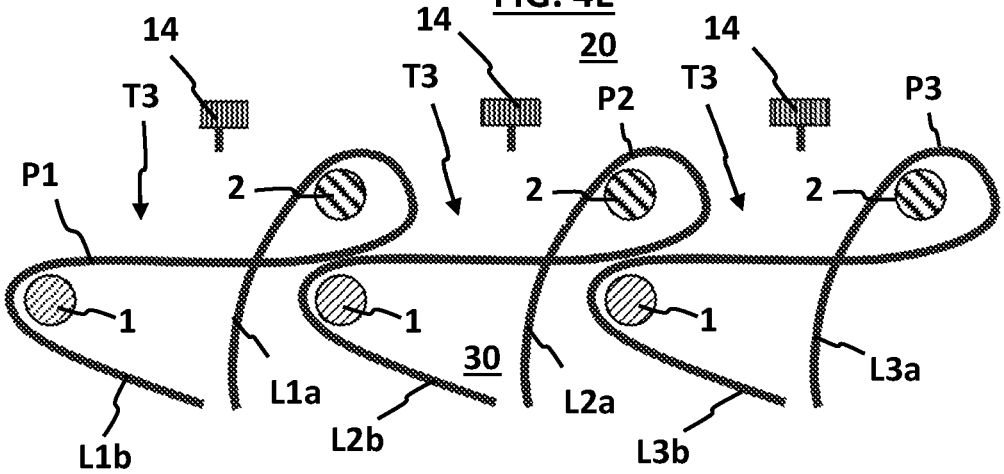
Figure 4G:
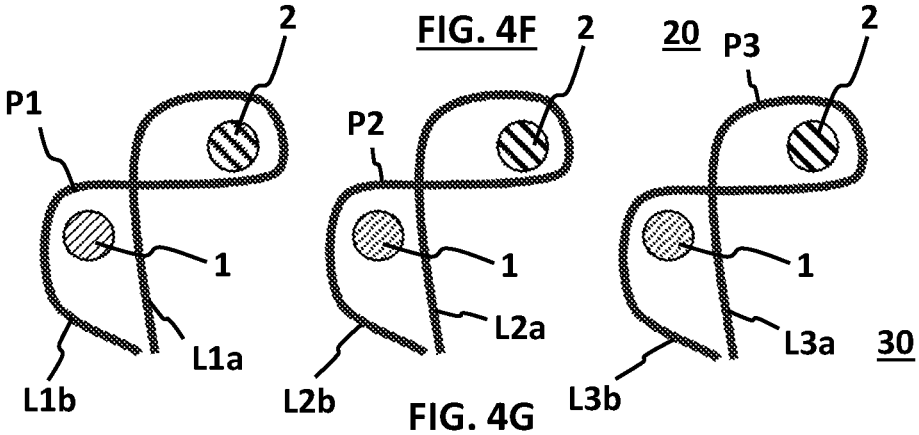
Figure 4H:
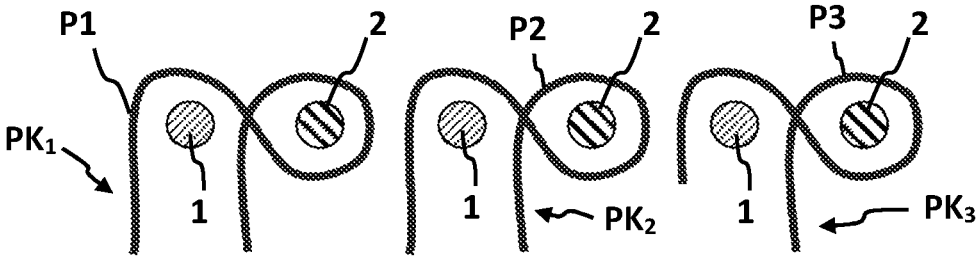
Figure 5C:
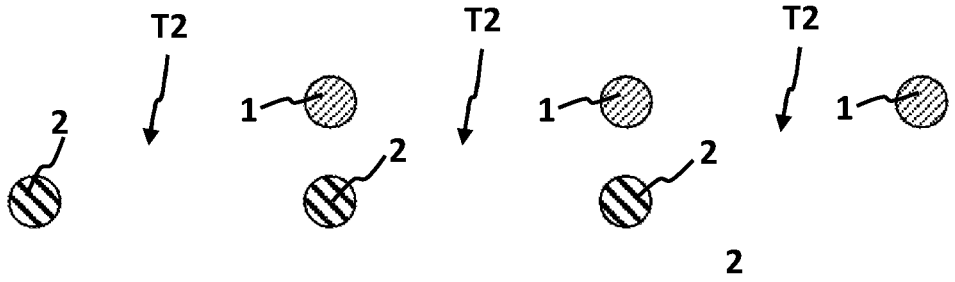
Figure 5D:
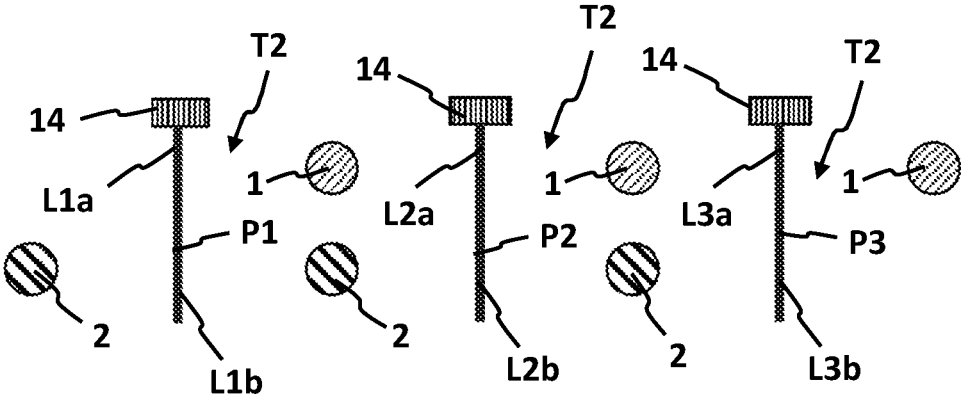
Figure 5E:
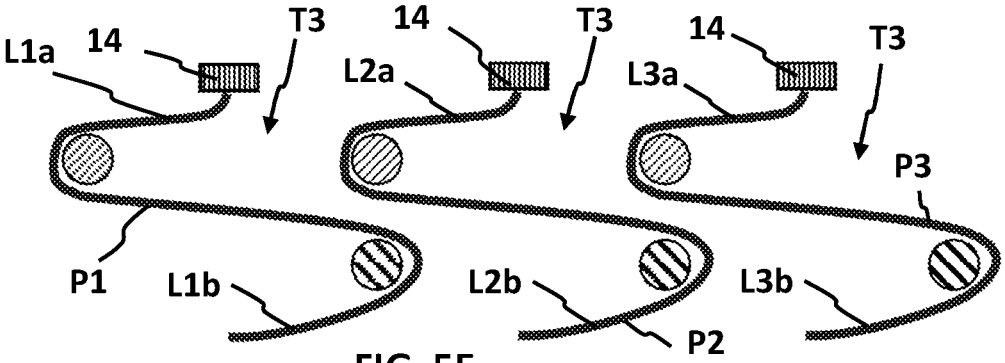
Figure 5F:
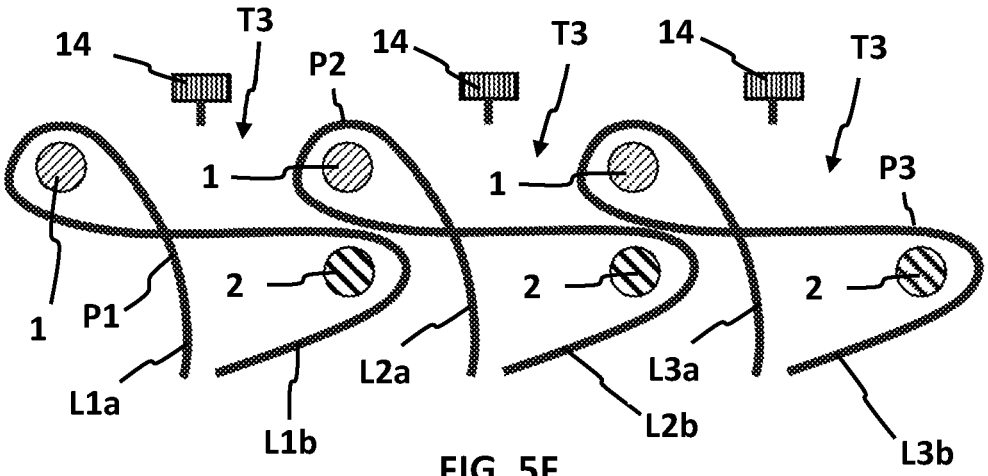
Figure 5G:
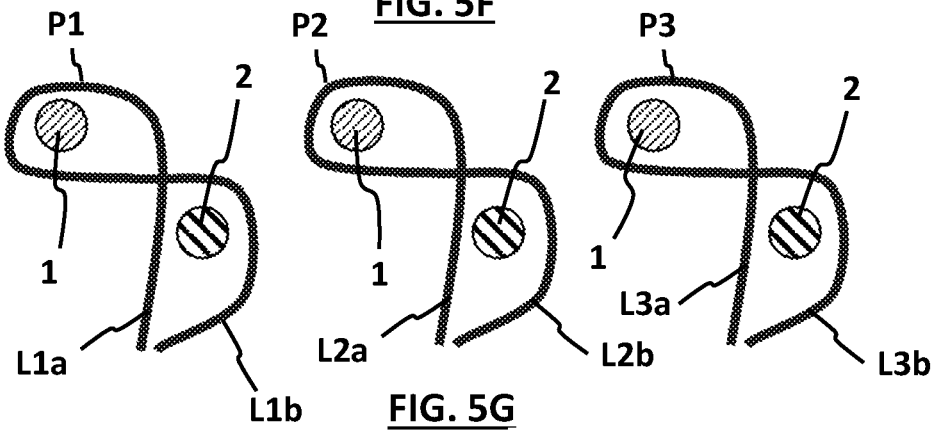
Figure 5H:
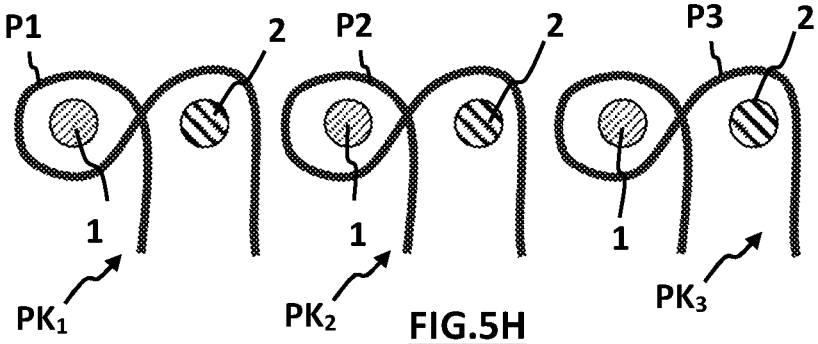

In step 2, the first positioning body (6) and the second positioning body (10) are moved in opposite directions in the weft direction (X) so that the order of the first and the second warp yarns of each sequence (I), (II), (III)—the order seen in the weft direction (X)—is reversed, following the principle that was also shown in FIGS. 4C and 5C. The state of the weaving machine after carrying out this step 2 is shown in FIGS. 9 and 10. In FIG. 10, the first weft yarns (1) are pulled towards the right and the second weft yarns (2) are pulled towards the left. Seen in a plane that runs parallel to the warp yarn plane (K)—the plane in FIG. 10—the paths of the warp yarns (1), (2) are altered between the beam installation (5) and the fabric edge (18). The first warp yarns (1) now follow an altered path wherein, from the beam installation (5) to the first positioning body (6), they are first moved obliquely towards the right of the original path line (40) and then, from the first positioning body (6) to the fabric edge (18), they again run obliquely to this original path line (40). The second warp yarns (2) now follow an altered path wherein, from the beam installation (5) to the second positioning body (10), they are first moved obliquely towards the left of the original path line (41) and then, from the second positioning body (10) to the fabric edge (18), they again run obliquely to this original path line (41). The first warp yarns (1) and the second warp yarns (2) of the different sequences cross each other, so that their order in the weft direction (X) is reversed. At the level of the pile yarn feeders (14) and the pile yarn receivers (15), between each first (1) and second warp yarn (2) of each sequence, a passage (T2) is provided (also called second gap (T2)).

In step 3, the pile yarn feeders (14) are operated so that, through any movement in the warp direction (Z), the desired pile yarn (P1), (P2, (P3) is held in or brought into the feed position, and the lower rapiers (15*b*) of the pile yarn receivers (15) are moved in the transverse direction (Y) to a position wherein, extending through the second gaps (T2), they can grip the pile yarn supplied by the associated pile yarn feeder (14), and the lower rapiers (15*b*) are also operated to grip the end portion of the selected pile yarn, held in the feed position. The state of the weaving machine, after carrying out step 3, is shown in FIG. 11.

In step 4, the lower rapiers (15*b*) are moved in the transverse direction (Y) towards the right until they are on the other edge (30) of the warp yarn plane (K) in a position wherein they have pulled a desired length of the pile yarn (P1), (P2), (P3) (which is then still joined to a pile yarn supply) through the passages (17) past the cutting device (16). The desired length is determined by the desired pile height of the carpet. The pile yarns then extend via the second gap (T2), wherein the second end portion (L1*b*), (L2*b*), (L3*b*) of each pile yarn (P1), (P2), (P3) is located on the other edge (30) of the warp yarn plane (K) and the pile yarn is in the aforementioned pull-through position, as is also shown in FIGS. 4D and 5D. The state of the weaving machine, after carrying out step 4, is shown in FIG. 12.

In step 5, the first positioning body (6) and the second positioning body (10) are moved in opposite directions in the weft direction (X) so that the first and the second warp yarns of each sequence are back in the original order, following the principle that was also shown in FIGS. 4E and 5E. Between the first and the second warp yarns of the sequences, there is in each case a passage in the transverse direction, which is called a third gap (T3). After this step 5, the weaving machine is in the state that is shown in FIG. 13. In contrast to what is shown in FIGS. 4 E and 5 E, the warp yarns have not yet returned to their original position with vertical path lines.

In step 6, the second positioning body (10) is moved downwards in the warp direction (Z) until the upper rapier (15*a*) is at the same height as the first end part (L1*a*) of the pile yarn that is then still on the one edge (20) of the warp yarn plane (K) and is still joined to the pile yarn supply. After this step 6, the weaving machine is in the state that is shown in FIG. 14.

In step 7, the upper rapiers (15*a*) of the pile yarn receivers (15) are moved in the transverse direction (Y) to a position wherein, extending through the first gaps (T1), they can grip the first end part (L1*a*) of the pile yarn (P1) held by the associated pile yarn feeder (14), and the upper rapiers (15*a*) are also operated to grip said first end portion (L1*a*) as well. The state of the weaving machine, after carrying out step 7, is shown in FIG. 15.

In step 8, the cutting device (16) is operated to cut off the pile yarns (P1), (P2), (P3) from the pile yarn supply. For this purpose, the slidable cutting portion (16*b*) is moved along the longitudinal axis (W) of the fixed portion (16*a*) of the cutting device (16), so that all pile yarns that extend through a respective passage (17) of the cutting device are cut through. In order to bring the pile yarns (P1), (P2), (P3) into an extended state before they are cut through, the upper rapiers (15*a*), which in the previous step 7 had gripped the first end portions of these pile yarns (P1), (P2), (P3), are first moved away over a small distance in the transverse direction (Y) from the cutting device (16).

In step 8, the upper rapiers (15*a*) are also pulled back in the transverse direction (Y) to the other edge (30) of the warp yarn plane (K), to a position wherein the upper rapier (15*a*) and the lower rapier (15*b*) of each pile yarn receiver (15) are moved to the same distance from the warp yarn plane (K) and respectively keep the first (L1*a*), (L2*a*), (L3*a*) and the second end part (L1*b*), (L2*b*), (L3*b*) of a pile yarn (P1), (P2), (P3) extended, so that the knots ($PK_1$), ($PK_2$), ($PK_3$) are formed. Then the situation that was shown in FIGS. 4F and 5F is reached.

In step 8, the first (6) and the second positioning body (10) are also again moved towards each other in the transverse direction (Y), so that the first (1) and the second warp yarns (2) again extend in the same warp yarn plane (K). Then the situation is reached that was shown in FIGS. 4G and 5G. The state of the weaving machine, after carrying out step 8, is shown in FIG. 16.

In step 9, the second positioning body is moved downwards in the warp direction (Z) so that the underside of the fingers (12) exert a downward force on the knots ($PK_1$), ($PK_2$), ($PK_3$) (KP) and these are moved downwards, wherein they are displaced over the warp yarns (1), (2), and are pressed well against the fabric edge (18). The state of the weaving machine, after carrying out step 9, is shown in FIG. 17.

In step 10, the upper rapier (15*a*) and the lower rapiers (15*b*) are placed in the open state so that the end parts (L1*a*), (L2*a*), (L3*a*); (L1*b*), (L2*b*), (L3*b*) of the pile yarns (P1), (P2), (P3) are released and the second positioning body (10) is moved upwards again in the warp direction (Z). The weaving machine is then in the state in FIG. 18. After step 10, the pile forming cycle has ended.

The weft insertion cycle comprises the steps indicated hereunder.

In step 11, the first positioning body (6) and the second positioning body (10) are moved in the transverse direction (Y) away from each other in opposite directions so that the first (1) and the second warp yarns (2) are some distance apart in the transverse direction (Y) and follow an altered path similarly to step 1. However, this is done in order to form a shed between the first warp yarns (1) and the second warp yarns (2) for inserting a first weft yarn (3). The weaving machine is shown in FIG. 19 after this shedding. On the one edge (20) of the warp yarn plane (K), the first warp yarns (1) are pulled away from the warp yarn plane (K) and are thus on the left-hand side of the shed. On the other edge (20) of the warp yarn plane (K), the second warp yarns (2) are pulled away from the warp yarn plane (K) and are thus on the right-hand side of the shed.

In step 12 (see FIG. 20), a first weft yarn (3) is inserted in the weft direction (X) via a rapier system, which is not shown in the figures. In step 13, this weft yarn is moved towards the fabric edge (18) by moving the second positioning body (10) downwards in the warp direction (Z) so that the underside of the fingers (12) exerts a downward force on the weft yarns (3) and these also move downwards and press well against the fabric edge (18). The state of the weaving machine, after carrying out step 13, is shown in FIGS. 21 and 22.

In step 14, a shed is then again formed between the first (1) and the second warp yarns (2). Now, however, relative to the first shed that is formed in step 12, a reversed shed is formed. This is shown in FIG. 23. The first (6) and the second positioning body (10) are moved towards each other in the transverse direction so that each finger (8) of the first positioning body (6) is located above a respective gap between two fingers (12) of the second positioning body (10) and each finger (12) of the second positioning body (10) is located under a respective gap between two fingers (8) of the first positioning body (6). See the portion of FIG. 23 within the circle (C). As a result, the first warp yarns (1) are pushed towards the other edge (30) of the warp yarn plane (K) and the second warp yarns (2) are pushed towards the one edge (20) of the warp yarn plane (K). The positions of the first and the second warp yarns are thus reversed compared to their positions in the shed that was formed in step 11.

In step 15 (not shown in the drawings), a second weft yarn (4) is then inserted in this shed in the weft direction (X) via the rapier system. Through the reversing of the positions of the first (1) and the second warp yarns (2) in the first and the second shed, these two weft yarns (3), (4) run in opposition of phase, alternately on the one edge (20) and on the other edge (30) of the successive warp yarns (1), (2), as is also shown in FIGS. 1 and 2.

Finally, in step 16 (also not shown in the drawings), similarly to step 13, the second weft yarn (4) is also moved towards the fabric edge (18) by the second positioning body (10) downwards in the warp direction (Z). With that, the weft insertion cycle has ended, and a next pile forming cycle can be carried out, followed by a weft insertion cycle.

By operating said components of this weaving machine to carry out a pile forming cycle and a weft insertion cycle numerous times alternately, a carpet is woven automatically with alternately a row of Persian knots and two weft yarns that are interwoven with the warp yarns. The carpet thus produced is wound automatically on the carpet winding mechanism (19).

A second embodiment of the weaving machine (see FIGS. 24 to 30) differs from the first embodiment described above in that the pile yarn feeder (50) is configured differently, in that the cutting device is mounted on the other edge (30) of the warp yarns, and in that the upper rapier (15*a*) and the lower rapier (15*b*) of each pile yarn receiver (15) are not connected to the second positioning body (10), but are movable separately up and down in the warp direction (Z).

On the one edge (20) of the warp yarns, a pile yarn feeder (50) is provided, comprising an elongated supporting element (51) movable in the transverse direction (Y), which extends in the weft direction (X), and carries a row of yarn tubes (52)-(56) that extend parallel to each other in the transverse direction (Y) from the supporting element (51) to the warp yarns (1), (2). The yarn tubes (52)-(56) are hollow and have two open ends. Five pile yarns (Pa)-(Pe) run from a respective supply (not shown in the figures) via a respective opening in the (not visible) back of the supporting element (51) into a respective yarn tube (52)-(56), run through the hollow yarn tube and end with a yarn end that projects on the open end of the yarn tube (52)-(56) directed towards the warp yarns.

Between the supporting element (51) and the warp yarns (1), (2), a fixed guide element (57) is provided, in which a row of guide openings is provided. Each yarn tube (52)-(56) extends through a respective guide opening. By moving the supporting element (51) in the transverse direction (Y), the yarn tubes (52)-(56) are moved towards the warp yarns (1), (2) or are moved away from the warp yarns. The yarn tubes (52)-(56) are moved thereby into the guide openings of the guide element (57).

In each supporting element (51), a clamping device is provided, which may be placed in a closed state to prevent the pile yarns (Pa)-(Pe), which run via the supporting element (51) through a respective yarn tube (52)-(56), being moved relative to the supporting element (51). The clamping device may also be placed in the open state to allow the pile yarns (Pa)-(Pe) to be moved relative to the supporting element (51).

As stated, the cutting device (58) of the second embodiment is now mounted on the other edge (30) of the warp yarns (1), (2). Otherwise it is identical to the cutting device (16) in the first embodiment of the weaving machine.

All other elements of this weaving machine are also identical to the corresponding elements of the first embodiment, and are indicated in FIGS. 24-30 with the same reference numbers. This applies in particular to the first (6) and the second positioning body (10), to the warp yarns (1), (2) that are unwound in a warp yarn plane (K) from a beam installation (5), and to the carpet winding mechanism (19). The pile yarn receivers (15) only differ in that the upper rapier (15*a*) and the lower rapiers (15*b*) are not fastened to the underside of the second positioning body (10), but these are also otherwise identical. The way in which all elements interact to form Persian knots ($PK_1$), ($PK_2$), ($PK_3$) is also the same as in the first embodiment. For a detailed description of these elements and their action and interaction with each other and with other elements, reference should thus be made to the above description of the first embodiment of the weaving machine.

The action of the differently configured pile yarn feeder (50) is illustrated on the basis of FIGS. 25-30, which show six successive states of the weaving machine during the production of a Persian carpet.

FIG. 25 shows the state wherein the first (1) and the second warp yarns (2) are some distance apart in the transverse direction (Y) and wherein the first (6) and the second positioning element (10) are also moved in opposite directions in the weft direction (X) relative to each other so that the order of the first (1) and the second warp yarns (2), seen in the weft direction (X), is reversed. The pile yarn feeder (50) and the pile yarn receivers (15) are in the starting position.

In a first phase of the operation of the weaving machine, the supporting element (51) of the pile yarn feeder (50) is moved in the transverse direction (Y) until the yarn tubes (52)-(56) extend through a respective second gap (T2) between a first (1) and second warp yarn (2) in reversed order. The yarn clamp is then in the closed state in order to prevent the pile yarn (Pa) being pulled back out of the pile tubes (52)-(56) by the withdrawal force exerted on the pile yarn in the direction of the bobbin creel. The lower rapier (15*b*) of the associated pile yarn receiver (15) is closed so that the yarn end of the pile yarn (Pa) projecting from the yarn tube (52) is gripped by the rapier (15*a*). Then the yarn clamp is opened. After this first phase, the weaving machine is in the state that is shown schematically in FIG. 26.

In a second phase of the operation of the weaving machine, the supporting element (51) of the pile yarn feeder (50) is moved in the transverse direction (Y) until the yarn tubes (52)-(56) are back on the one edge (20) of the warp yarns (1), (2). Because the lower rapiers (15*b*) grip the pile yarns (Pa), the pile yarns are not moved as well, so that a certain length of each pile yarn now extends between the end of the associated yarn tube (52)-(56) and the associated rapier (15*b*). This length is the length that the pile yarns must have in order to obtain a carpet with the desired pile height. The end portion of the pile yarn, which is provided for forming the pile yarn after it is cut off, is now called the pile yarn and as such is indicated with the reference number (P1). After this second phase, the weaving machine is in the state that is shown schematically in FIG. 27.

In a third phase of the operation of the weaving machine, the first (6) and the second positioning body (10) are again moved in the weft direction (X) until the first and the second warp yarns (2) of the different sequences are again located in the original order on either side of a respective third gap (T3). The pile yarn receivers (15) are moved downwards in the warp direction (Z) until each upper rapier (15*a*) is at the same height as the associated yarn tube (52). After this third phase, the weaving machine is in the state that is shown schematically in FIG. 28.

In a fourth phase of the operation of the weaving machine, the yarn clamp is placed in the closed state and the supporting element (51) is moved again towards the warp yarns (1), (2) until each yarn tube (52) extends through a respective third gap (T3) between a first (1) and a second warp yarn (2). The second end part (L1*b*) of each pile yarn—still joined to the pile yarn (Pa)—is then gripped by this upper rapier (15*a*). After this fourth phase, the weaving machine is in the state that is shown schematically in FIG. 29.

In a fifth phase of the operation of the weaving machine, the cutting device (58) cuts each pile yarn (P1) off of the pile yarn (Pa), and the supporting element (51) is moved back in the transverse direction (Y) until the yarn tubes (52)-(56) are back on the one edge (20) of the warp yarns (1), (2). The pile yarns now form Persian knots ($PK_1$), ($PK_2$), ($PK_3$). As the last step of the pile forming cycle, the first (1) and the second warp yarns (2) are again brought into the warp yarn plane (K) by moving the first (1) and the second positioning body (10) towards each other in the transverse direction (Y).

Then the Persian knots are moved towards the fabric edge and/or pressed against this fabric edge (18) by displacement of the second positioning body (10), in the same way as described above (step 9 and step 10) in relation to the first embodiment of the weaving machine.

Then a weft insertion cycle is carried out that is identical to the weft insertion cycle that is described above (steps 11 to 16 inclusive) in relation to the first embodiment of the weaving machine.

The invention claimed is:

1. Weaving machine for weaving pile fabrics, comprising:

yarn providers for providing a row of warp yarns running next to each other, a shedding device for forming a shed between the warp yarns in each case in several weft insertion cycles, a weft insertion mechanism for inserting, in the weft insertion cycles, in each case at least one weft yarn in the shed in a weft direction in order to weave a ground fabric, and binders for binding pile yarns to the ground fabric to form the pile, wherein the weaving machine is configured so that, in several pile forming cycles, for several sequences of a first and of a second warp yarn system each comprising at least one warp yarn in the row of warp yarns and located in an original order seen in the weft direction on either side of a first gap:

(a) the warp yarns of at least one of the first and the second warp yarn systems in the weft insertion mechanism are moved until the warp yarn systems are located, at least over a portion of their length, in a reversed order on either side of a second gap, (b) a pile yarn in the pile yarns is brought into a pull-through position where the pile yarn extends through the second gap between the first and the second warp yarn system and projects with respective end parts on both sides of the warp yarns, (c) the warp yarns of at least one of the first and second warp yarn systems are moved in the weft direction until at least one warp yarn of the first warp yarn system and at least one warp yarn of the second warp yarn system are back again in the original order on either side of a third gap, and (d) the end part of the pile yarn located on one edge of the warp yarns is pulled through the third gap so that the end part of the pile yarn extends via the third gap up to the other side of the warp yarns and projects on the other edge of the warp yarns.

2. Weaving machine according to claim 1, wherein the weaving machine is configured so that, in step (c), the warp yarns of at least one of the warp yarn systems are moved in the weft direction until all warp yarns of the first warp yarn system and all warp yarns of the second warp yarn system are back in the original order on either side of the third gap.

3. Weaving machine according to claim 1, further comprising a warp yarn positioning device that is configured to move the warp yarns of the first warp yarn system and/or the warp yarns of the second warp yarn system at least over a portion of their length in a transverse direction that is approximately transverse to the warp yarn plane in which the warp yarns mainly extend, so that the warp yarns of the first warp yarn system and the warp yarns of the second warp yarn system of each sequence in the several sequences are displaced, at least over a portion of their length in the transverse direction, relative to each other, and then move the warp yarns of the first warp yarn system and/or the warp yarns of the second warp yarn system of each sequence in the weft direction relative to each other in order to reverse the order of the warp yarn systems, as seen in the weft direction.

4. Weaving machine according to claim 3, wherein the warp yarn positioning device further comprises at least one first positioning body that is configured:

to be moved in the transverse direction and thereby also move the warp yarns of the first warp yarn system of each sequence in the several sequences in order to bring the warp yarns of the first warp yarn system at least over a portion of their length outside the warp yarn plane, and to be moved in the weft direction and thereby also move the warp yarns of the first warp yarn system of each sequence in the several sequences in order to reverse the order of the warp yarn systems, as seen in the weft direction.

5. Weaving machine according to claim 4, wherein the warp yarn positioning device further comprises at least one second positioning body that is configured:

to be moved in the transverse direction and thereby also move the warp yarns of the second warp yarn system of each sequence in the several sequences in order to bring the warp yarns of the second warp yarn system at least over a portion of their length outside the warp yarn plane, and to be moved in the weft direction and thereby also move the warp yarns of the second warp yarn system of each sequence in the several sequences in order to reverse the order of the warp yarn systems, as seen in the weft direction.

6. Weaving machine according to claim 5, wherein the at least one first positioning body is provided on the one side of the warp yarns and is configured to move the warp yarns of the first warp yarn system at least over a portion of their length in the transverse direction so that they are brought on the one side of the warp yarns outside the warp yarn plane, and wherein the at least one second positioning body is provided on the other side of the warp yarns and is configured to move the warp yarns of the second warp yarn system at least over a portion of their length in the transverse direction so that they are brought on the other side of the warp yarns outside the warp yarn plane.

7. Weaving machine according to claim 6, wherein the at least one first positioning body and/or the at least one second positioning body comprise a row of warp yarn passages.

8. Weaving machine according to claim 7, wherein the at least one first positioning body and/or at least one second positioning body comprise a number of fingers that are provided next to each other with spacing, in which at least one warp yarn passage in the row of warp yarn passages is provided.

9. Weaving machine according to claim 8, wherein, in each pile forming cycle, at least one pile yarn in the pile yarns is joined to a number of the warp yarns by forming a plurality of knots, wherein each knot in the plurality of knots is located between the edge of the ground fabric in the process of formation and at least one positioning body in the at least one first positioning body and/or the at least one second positioning body, and wherein the at least one positioning body is configured, in a direction in which the warp yarns extend next to each other, to be moved towards the edge in order to move each knot in the plurality of knots in this direction until the at least one positioning body is almost up against the edge.

10. Weaving machine according to claim 9, wherein the weft insertion mechanism inserts, in each weft insertion cycle, in each case at least one weft yarn in a weft direction into a shed formed between warp yarns, between the edge of the ground fabric in the process of formation and the at least one positioning body, and wherein the at least one positioning body is configured to be moved in the direction in which the warp yarns extend next to each other towards the edge in order to move each inserted weft yarn in the direction until the at least one positioning body is almost up against the edge.

11. Weaving machine according to claim 10, wherein the at least one positioning body is also configured to move, in several weft insertion cycles, the warp yarns of the first warp yarn system of each sequence in the several sequences and/or the warp yarns of the second warp yarn system of each sequence in the several sequences at least over a portion of their length in the transverse direction, to form in each case a shed between the respective warp yarns.

12. Weaving machine according to claim 1, further comprising a cutting device that is configured for cutting off, in several pile forming cycles, each pile yarn in the pile yarns to be bound to the ground fabric from a pile yarn supply.

13. Weaving machine according to claim 1, further comprising at least one set of (i) a pile yarn feeder, and (ii) an associated pile yarn receiver, wherein the pile yarn feeder is configured so that, in several pile forming cycles, a pile yarn in the pile yarns is held in a first feed position on the one side of the warp yarns, wherein the associated pile yarn receiver is configured so that, in several pile forming cycles, the pile yarn held in the first feed position on the other side of the warp yarns is pulled through a respective second gap between two warp yarn systems in reversed order and is brought into the pull-through position, and then, after at least one warp yarn of the first warp yarn system and at least one warp yarn of the second warp yarn system are put back again in the original order, the end part of the pile yarn located on the one side of the warp yarns is brought through the first gap so that the end part extends via the third gap up to the other side of the warp yarns and projects on the other side, and so that each pile yarn in the pile yarns is joined by formation of a plurality of knots to the warp yarns, and wherein the associated pile yarn receiver comprises two pile legs projecting on the other edge of the warp yarns.

14. Weaving machine according to claim 1, further comprising at least one set of (i) a pile yarn feeder, and (ii) an associated pile yarn receiver, wherein the pile yarn feeder is configured so that, in several pile forming cycles, a pile yarn in the pile yarns is held in a second feed position where the pile yarn extends from the one side of the warp yarns through a second gap between two warp yarn systems in reversed order up to the other side of the warp yarns, wherein the associated pile yarn receiver is configured so that, in several pile forming cycles, the associated pile yarn receiver grips the pile yarn held in the second feed position on the other side of the warp yarns and is brought into, or held in, the pull-through position, and then, after the warp yarn systems are put back in the original order, the end part of the pile yarn located on the one side of the warp yarns is pulled through the third gap so that the end part extends via the third gap up to the other side of the warp yarns and projects on the other side, and so that each pile yarn in the pile yarns is joined by formation of a plurality of knots to the warp yarns, and wherein the associated pile yarn receiver comprises two pile legs projecting on the other edge of the warp yarns.

15. Weaving machine according to claim 14, wherein the pile yarn feeder comprises an elongated hollow feed-through body that forms a passage for the pile yarn extending in its longitudinal direction, wherein the pile yarn feeder is configured to be placed in a first position where the feed-through body extends from the one side of the warp yarns through the second gap up to the other side of the warp yarns, in that the pile yarn extending through the passage of the feed-through body is held in the second feed position, wherein the associated pile yarn receiver is configured to retain the pile yarn held in the second feed position, and wherein the pile yarn feeder is configured so that, during retention of the pile yarn, the pile yarn feeder is moved from the first position to a second position wherein the feed-through body no longer extends through the second gap and is located completely on the one side of the warp yarns.

16. Weaving machine according to claim 13, wherein the pile yarn receiver is configured to be moved between a first and a second position in a transverse direction that is approximately transverse to the warp yarn plane in which the warp yarns mainly extend, in order to take, in the first position, a yarn end of a pile yarn brought into the first or the second feed position and bring the pile yarn, through the movement of the pile yarn receiver to the second position, into the pull-through position.

17. Weaving machine according to claim 13, wherein, for the at least one set of the pile yarn feeder and the associated pile yarn receiver, a row of the pile yarns with mutually different appearance-determining properties is provided, and wherein the pile yarn feeder is configured so that, in several pile forming cycles, the pile yarn feeder selectively brings a predetermined pile yarn in the pile yarns of the row into the first or the second feed position.

18. Weaving machine according to claim 13, wherein the pile yarn receiver comprises:

a first pile yarn rapier that is configured to grip the pile yarn brought into the first or the second feed position, and a second pile yarn rapier that is configured to grip in each case the end part of the pile yarn located on the one side of the warp yarns and pull the end part through the first gap.

19. Weaving machine according to claim 1, further comprising a row of warp yarns running next to each other, wherein the row of warp yarns extends mainly in a warp yarn plane (K), wherein the row of warp yarns comprises the several sequences of the first and second warp yarn systems, wherein each warp yarn system in the first and second warp yarn systems comprises at least one warp yarn, and wherein the first and second warp yarn systems are located in an original order, as seen in the weft direction, on either side of the first gap.

20. Weaving machine according to claim 18, further comprising:

at least one first positioning body that is placed on the one side of the warp yarns and is movable in a transverse direction that is approximately transverse to the warp yarn plane, in order to bring the warp yarns of the first warp yarn systems over a portion of their length on the one side outside the warp yarn plane, and is movable in the weft direction in order to move the warp yarns of the first warp yarn systems over a portion of their length in the weft direction in order to reverse the order of the warp yarn systems, at least one second positioning body that is placed on the other side of the warp yarns and is movable in the transverse direction to bring the warp yarns of the second warp yarn systems over a portion of their length on the other side outside the warp yarn plane, and is movable in the weft direction in order to move the warp yarns of the second warp yarn systems over a portion of their length in the weft direction in order to reverse the order of the warp yarn systems, wherein the weaving machine is configured so that, during several pile forming cycles, the following steps are carried out automatically:

(d) the first and the second positioning bodies are moved away from each other in the transverse direction in order to bring the first and the second warp yarns respectively on the one side and on the other side of the warp yarn plane outside the warp yarn plane, (e) the first and the second positioning bodies are moved relative to each other in the weft direction so that the order of the warp yarn systems is reversed, (f) the first pile yarn rapier is operated to grip the yarn end of the pile yarn placed in the first or the second feed position and is brought into, or held in, the pull-through position, (g) the first and the second positioning bodies are moved relative to each other in the weft direction so that at least one warp yarn of the first warp yarn system and at least one warp yarn of the second warp yarn system are back in the original order, on either side of the third gap, and (h) the second pile rapier is operated to pull the end part of the pile yarn located on the one side of the warp yarns through the third gap so that the end part extends via the third gap up to the other side of the warp yarns and projects on the other edge.

21. Weaving machine according to claim 20, wherein, during several weft insertion cycles, the weaving machine is configured to:

move the first and the second positioning bodies away from each other in the transverse direction in order to bring the warp yarns of the first warp yarn system and the warp yarns of the second warp yarn system respectively on the one side and on the other side of the warp yarn plane outside the warp yarn plane, so as to form a shed between the warp yarns of the first warp yarn system and the warp yarns of the second warp yarn system, operate the weft insertion mechanism in order to insert one or more weft yarns in the weft direction into the shed.

22. Method for manufacturing pile fabrics, wherein a number of warp yarns running next to each other is provided, wherein in several weft insertion cycles in each case a shed is formed between the warp yarns at least one weft yarn is brought into the shed in a weft direction so that a ground fabric is woven, and pile yarns are bound to the ground fabric to form the pile on the ground fabric, the method comprising:

in several pile forming cycles, for several sequences of a first and of a second warp yarn system each comprising at least one warp yarn in the warp yarns and located in an original order as seen in the weft direction on either side of a first gap:

(a) moving the warp yarns of at least one of the warp yarn systems in the weft direction until the warp yarn systems are located in a reversed order on either side of a second gap, (b) bringing a pile yarn in the pile yarns into a pull-through position where the pile yarn extends through the second gap between the first and the second warp yarn system and projects with two end parts on a respective side of the warp yarns, (c) moving the warp yarns of at least one of the warp yarn systems in the weft direction until at least one warp yarn of the first warp yarn system and at least one warp yarn of the second warp yarn system are back again in the original order on either side of a third gap, and (d) pulling an end part of the pile yarn located on the one side of the warp yarns through the third gap between the first and the second warp yarn system so that the end part of the pile yarn extends via the third gap up to the other side of the warp yarns and projects on the other edge.

23. Method for manufacturing pile fabrics according to claim 22, wherein, in step (c), at least one of the warp yarn systems is moved in the weft direction until all warp yarns of the first warp yarn system and all warp yarns of the second warp yarn system are back in the original order on either side of the third gap.

24. Method for manufacturing pile fabrics according to claim 22, wherein the warp yarns of the first warp yarn system and/or the warp yarns of the second warp yarn system, at least over a portion of their length, are moved in a transverse direction that is approximately transverse to the warp yarn plane in which the warp yarns mainly extend, so that the warp yarns of the first warp yarn system and the warp yarns of the second warp yarn system of each sequence in the several sequences are displaced relative to each other, at least over a portion of their length, in the transverse direction, and in that then the warp yarns of the first warp yarn system and/or the warp yarns of the second warp yarn system of each sequence in the several sequences are moved relative to each other in the weft direction in order to reverse the order of the warp yarn systems, as seen in the weft direction.

25. Method for manufacturing pile fabrics according to claim 22, wherein, in each weft insertion cycle, the warp yarns of the first warp yarn system and the warp yarns of the second warp yarn system are moved at least over a portion of their length in a transverse direction that is approximately transverse to the warp yarn plane in which the warp yarns substantially extend, so that the warp yarns of the first warp yarn system and the warp yarns of the second warp yarn system of each sequence in the several sequences are displaced relative to each other, at least over a portion of their length, in the transverse direction, so as to form a shed between the warp yarns, after which at least one weft yarn is brought into the shed in a weft direction.

26. Method for manufacturing pile fabrics according to claim 24, wherein the warp yarns of the first second warp yarn system and the warp yarns of the second warp yarn system are moved in the transverse direction so that they are brought, respectively, on the one side and on the other side of the warp yarn plane, outside the warp yarn plane.

* * * * *